US006431100B2

(12) United States Patent
Abshier

(10) Patent No.: US 6,431,100 B2
(45) Date of Patent: Aug. 13, 2002

(54) STOWABLE SEMI-RIGID WING SAIL SYSTEM

(76) Inventor: Charles Allen Abshier, 12545-D Corliss Ave. N., Seattle, WA (US) 98133

( * ) Notice: Subject to any disclaimer, the term of this patent is extended or adjusted under 35 U.S.C. 154(b) by 0 days.

(21) Appl. No.: 09/814,248

(22) Filed: Mar. 21, 2001

Related U.S. Application Data

(60) Provisional application No. 60/191,854, filed on Mar. 24, 2000.

(51) Int. Cl.[7] ..... B63H 9/04

(52) U.S. Cl. ..... 114/102.1; 114/102.22; 114/102.29; 114/102.12

(58) Field of Search ..... 114/89, 90, 97, 114/102.1, 102.12, 102.15, 102.22, 102.24, 102.27, 102.29, 102.32, 102.33, 104, 105, 39.21

(56) References Cited

U.S. PATENT DOCUMENTS

| | | | | | |
|---|---|---|---|---|---|
| 2,107,303 | A | | 2/1938 | Ljundstrom | |
| 3,580,203 | A | | 5/1971 | Martin | 114/39.31 |
| 3,611,969 | A | | 10/1971 | Hood | 114/106 |
| 4,263,686 | A | * | 4/1981 | Jarvis, Jr. | 441/116 |
| 4,344,377 | A | | 8/1982 | Gram | 114/102.13 |
| 4,402,277 | A | | 9/1983 | Wainwright | 114/102.22 |
| 4,685,410 | A | * | 8/1987 | Fuller | 114/102.22 |
| 4,741,281 | A | | 5/1988 | Doyle Sailmakers | 114/102.15 |
| 4,741,282 | A | | 5/1988 | Duke | 114/102.23 |
| 4,895,091 | A | * | 1/1990 | Elmali et al. | 114/102.24 |
| 5,051,293 | A | * | 9/1991 | Breitscheidel et al. | 428/121 |
| 5,271,349 | A | | 12/1993 | Magrini | 114/102.33 |
| 5,474,257 | A | * | 12/1995 | Fisher et al. | 244/49 |
| 5,640,919 | A | * | 6/1997 | Huisman | 114/106 |
| 5,671,690 | A | * | 9/1997 | Trost | 114/102.23 |
| 5,738,031 | A | * | 4/1998 | Malina | 114/102.1 |
| 5,778,814 | A | * | 7/1998 | Taylor | 114/97 |

* cited by examiner

*Primary Examiner*—Stephen Avila

(57) ABSTRACT

A stowable semi rigid airfoil assembly, functions automatically to airflow as a draft adjusting wing sail, or spinnaker sail (19), for use on a mast (17) with a halyard (41) on a wind powered craft. The halyard connected to the heads (83) of port and starboard sail panels (10) surrounding the mast vertically, elongates the airfoil from a "wing chord section shaped boom" (21) attached to the airfoils' foot (57). The sailcloth (12) panels are laminated with rigid foam cored (11) horizontal panel sections (13) set between flexible sailcloth spaces (14), for folding the rigid panels down over the wing shaped boom. The top of the panel sections above the boom are outward folding (22) spaces, and every other one of the spaces up the sail are outward folding, and every other one of the other spaces are inward folding (16) and are increased in separation (20) between the rigid panels. The leading edges (27) of the sail panels are joined at the inward folding spaces. The sail panels have shape control lines (34) along the inward folds for a wing chord section profile. Downhaul lines (31) reef and stow the sail panels. The leading edge of the boom pivots the trailing two sides of the boom from the mast. The flexible booms' pivotable leading edge is connected to a telescoping (48) fore boom (45) that is distally connected to the mast. Pivotable connections of the spinnaker (49) and draft control arms (50) between the foreboom and the inboard sides of the boom (55) adjust the draft of the wing sail.

18 Claims, 15 Drawing Sheets

44
11
12
23
68
33
44
44

1C 3
23
22
22
11
29
20
16
33
22
23
27
11
22
16
20
33
11
23
33
22
16
22
27
11
14
22
22
14
23
29
27
20

17
41
69
83
16
22
10
29
18
81
46
62
15
25
26
27
60
57
53
42

8E
41
83
84
32
70
31
69
17
29
25
27
22
16
57
39
46
60
62
63
50
55
49

17
22
27
16
10
43
49
62
31
29
20
23
66

STOWABLE SEMI-RIGID WING SAIL SYSTEM

CROSS-REFERENCE TO RELATED APPLICATIONS

This application is entitled to the benefit of Provisional Patent Application Ser. #60/191,854, filed Mar. 24, 2000.

BACKGROUND

1. Field of Invention

The invention herein relates to sails, specifically wing sails for wind powered craft.

2. Description of Prior Art

Designers and manufacturers of wind powered craft, supply consumers with a number of custom sails for a specific sailing craft. Sail designers and sail makers provide the most efficient designs possible for the current technology. Racing and cruising sailors are the impetus for product development, toward more power, simplicity of use, and safety.

Sails with the most power are not easy to use, and are not safe to use with possible high winds. The most common sails are not easy to use, and suffer a loss of efficient use of the winds power of up to thirty seven percent. Even in the hands of professionals, sail trim requires a lot of attention, and handling to keep the power of the wind working for the craft.

For wind powered craft, it has been a long held claim, that the solid wing with flaps and headsail twist, is the one hundred percent efficient use of the winds power. An example is Wainwrights; Aerofoil Sail, U.S. Pat. No. 4,402,277 in 1983. However, solid wings come short of this claim. For airfoil shape control, solid wings have huge flaps. These wings require a substantial amount of adjustment. An airfoils efficiency is in direct proportion to its' draft to chord ratio, which must change with increased, or decreased wind speeds automatically. Solid wings are not flexible enough to change draft, or flatten the windward panel automatically. Rigid wings have a substantial reduction of useful efficiency, as they cannot be stowed, and the whole wing must be hauled out for possible high wind speeds. Additional sails are required for all useable wind conditions, and the craft cannot stow away a spare wing.

Semi rigid wings made of battened sailcloth answer the need for stowing a wing, however, the wind applied to the soft surface buckles the sailcloth back inside of the wing and jams the folding process. Additionally, to be efficient, a wing has to have a more rigid leading edge, of which sailcloth with battens does not provide. For example, reference Magrini's, Wing Sail Structure, U.S. Pat. No. 5,271,349 in 1993, and Elmali's reversible camber line flexible wing sail, U.S. Pat. No. 4,895,091 in 1990. Another soft wing sail variation is Ljundstrom's Rig, U.S. Pat. No. 2,107,303 in 1938. A boom-less, batten-less, soft twin sail that stows wound up around a rotating mast, and can be spread apart for following winds. On the wind, the mast forms the leading edge inside the twin sails. When reefed, the rolled up dual panels become the same as a standard single sail panel, which is an inefficient airfoil shape.

Lapwing Rig, by H. G. Hasler, around 1960, reference; Singlehanded Sailing 2nd Edition, page 128, by Richard Henderson, 1988 International Marine Publishing Company. A "Modified Ljundstrom rig", added twin booms. For following winds, the clew of the twin booms can be separated, allowing the sail panels to wing out, and form a following wind sail. The boom is an improvement, but the airfoil remains as inefficient as standard soft sails.

Gallant Rig, by Jack Manners Spencer, of England, reference; Singlehanded Sailing 2nd Edition, page 128, by Richard Henderson, 1988, International Marine Publishing Company. A fully battened soft twin sail, enveloping the mast. Stows horizontally. This sail is also soft, and inefficient. The battens make it difficult to adjust the airfoil shape from head to foot.

Compromises between solid wing, and standard sail have been made, in efforts to improve efficiency and safety for everyday use. An example is the "Lady Helmsman" by Austin Farrar in 1965, reference; Faster The Quest For Sailing Speed, page 56, by David Pelly, 1984, Hearst Marine Books. The rotating partial solid wing mast, with a fully battened mainsail improves efficiency over that of standard sails. However, safety for the craft is compromised by storm winds, and by the increased weight affecting the righting moment. Also, as with standard sails, the airfoil shape is not automatic, and is complex to adjust. Additional sails are required for all useable wind conditions.

N.A.C.A. 653-418 wing section, by John H. Quinn Jr., 1944, wing section with boundary layer control by suction through a span wise slot at the point of separated flow in the leeward surface. Reference; Theory Of Wing Sections, page 236, by Abbott and Doenhoff, 1959, Dover Publications. A mechanical pump provides suction. The solid wing section as described is a one direction lifting airfoil. Intended for, and suitable only for "heavy displacement aircraft".

Airfoils of single panel sailcloth suffer a substantial loss of efficient use of the winds power. Which can be as much as a 17 to 37% loss of efficiency, when compared to wing sails. Rating reference; The Cruising Catamaran Advantage, page 165, by Rod Gibbons, 1988, Island Educational Publishing. Many changes of sails are required for different wind conditions. Also they require constant adjusting to control their airfoil shape. With a shaped mast there is only a slight increase in efficiency. This efficiency is increased slightly more with the masts ability to rotate its leading edge toward the wind. Standard sails are the most widely used, whether for working, sport, or pleasure craft. These sails are inefficient, and are not safe to use, because they are not easy to change. Rapidly degrading weather can ruin the sails, and inflict serious injury to persons handling them. To reduce the danger of handling sails away from the safety of the cockpit, roller reefing systems were introduced, such as Ted Hoods' Jib-Furling Stay, U.S Pat. No. 3,611,969 in 1971. However, the sails made for roller reefing systems are soft, and do not hold their airfoil shape sufficiently.

BRIEF SUMMARY OF INVENTION

In accordance with the present invention a stowable wing comprises "dual semi-rigid sail panels" that furl (unfold) or reef (fold down), has an automatic draft (thickness of wing) adjusting boom that bends to the shape of a wing or opens as a spinnaker sail. Wing sail shape is comprised of "smooth laminated lightweight cored" sail panels, with shape control springlines, twin booms, and spare sail pockets.

Objects and Advantages

Accordingly, several objects and advantages of the present invention are:

(a) to provide a rigid wing sail for a multitude of different wind powered craft.

(b) to provide a rigid wing sail that is one hundred percent efficient in its use of the winds power.

(c) to provide a rigid wing sail that folds up or down to a desired setting.

(d) to provide a rigid wing sail that is flexible enough to bend to a desired shape.

(e) to provide a rigid wing sail that easily adjusts its shape to the optimum setting for deriving the most power from the wind.

(f) to provide a rigid wing sail that stows its spare panels, freeing up space normally taken by spare bags of sails.

(g) to provide a rigid wing sail that automatically adjusts wing chord draft.

(h) to provide a rigid wing sail that automatically sets as a wing sail or spinnaker sail to the direction of the wind.

(i) to provide a rigid wing sail that is lightweight enough to replace existing sail systems.

(j) to provide a rigid wing sail system that is lower in cost than other standard sail systems' entire suits of sails.

(k) to provide a rigid wing sail that is safer for everyday use.

(l) to provide a rigid wing sail that as a single system, can be used as a source of power for sailing craft, in all but the most intolerable wind strengths.

(m) to provide a rigid wing sail that has a higher lift to drag ratio for sailing closer upwind.

(n) to provide a rigid wing sail that balances the sail across the mast for easier operation, and less strain on the sail handling gear.

(o) to provide a rigid wing sail with a center of effort that is placed forward to be compatible with existing mast locations of sailing craft.

Further objects and advantages are to provide a rigid wing sail that with its improved efficiency has a lowered designed height, which lowers the centers of both effort and gravity. Thereby, providing the wind powered craft with a higher righting moment. Additionally, causing less heeling of the craft, which further improves efficiency by standing the sail up for less airflow to spill off. Still further objects and advantages will become apparent from a consideration of the ensuing description and drawings.

DRAWING FIGURES

In the drawings, closely related figures have the same number but different alphabetic suffixes. Extra drawings without lead lines are supplied to delineate details.

Figure 1:
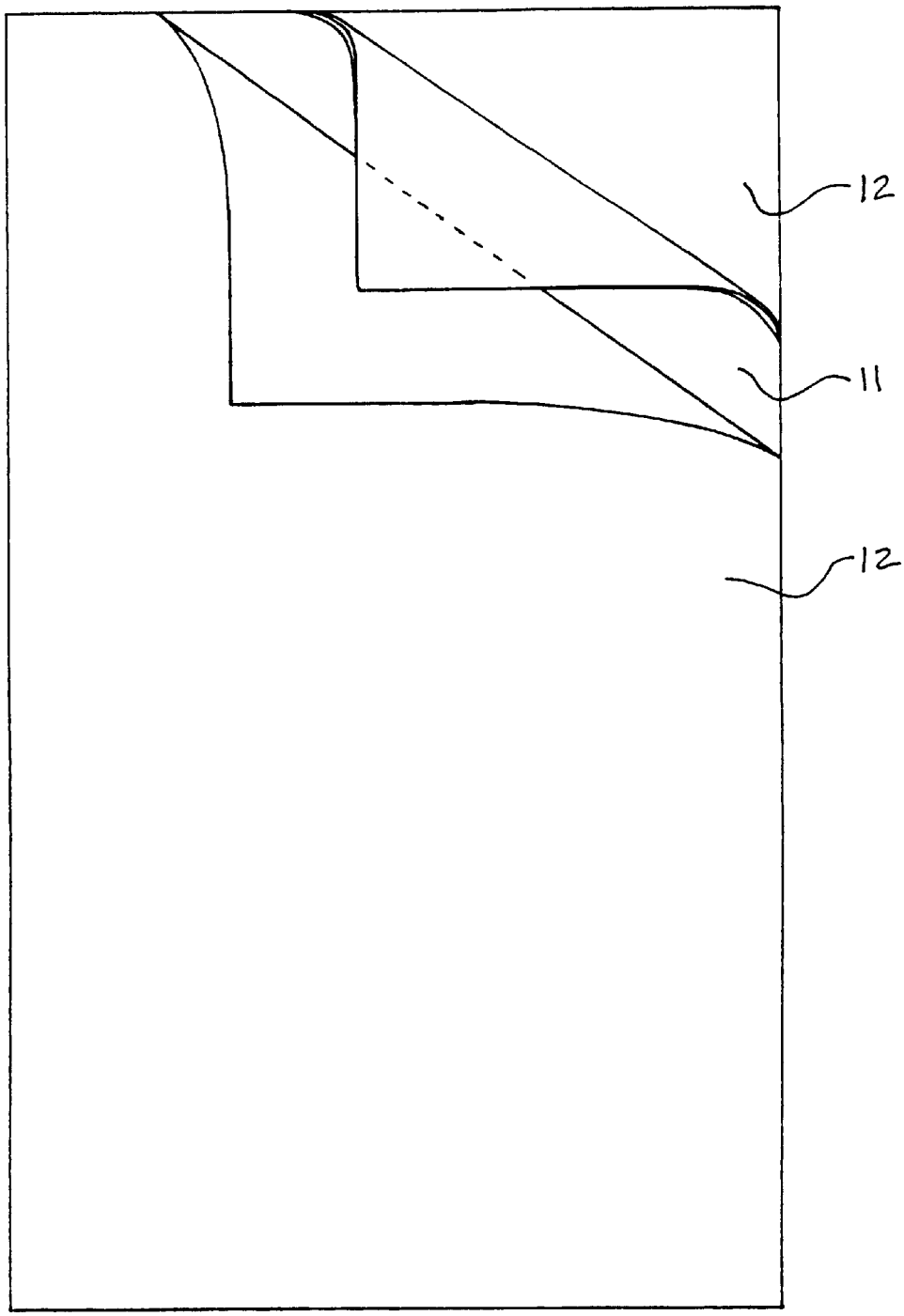
FIG. 1 shows a side view of a laminated panel with peeled back layers.
Figures 1A, 1B, 1C:
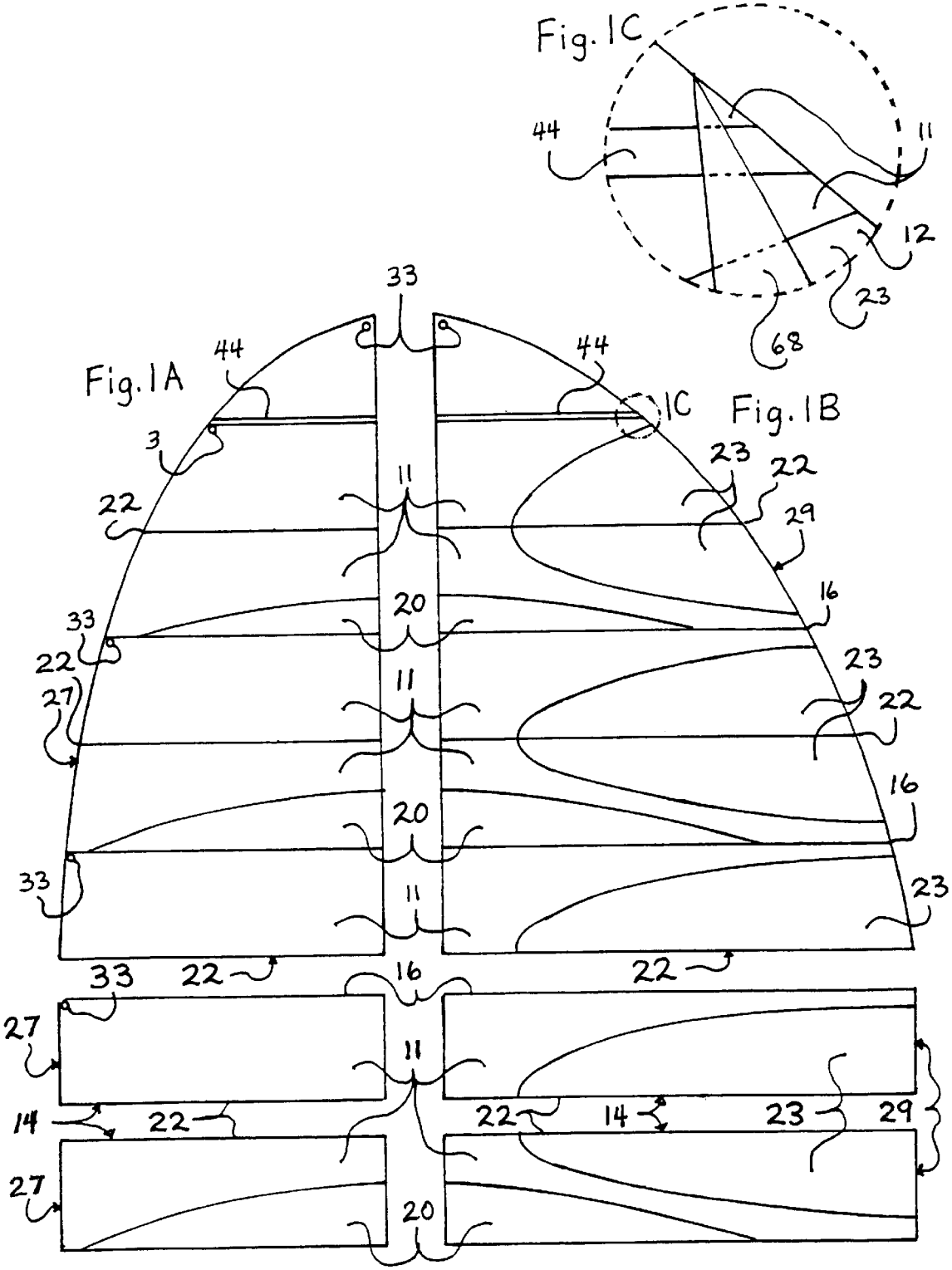
FIGS. 1A and 1B show side views of sail panels with foam core sections.

Detail FIG. 1C shows a detail view of FIG. 1B leach with sailcloth peeled back.

Figure 2:
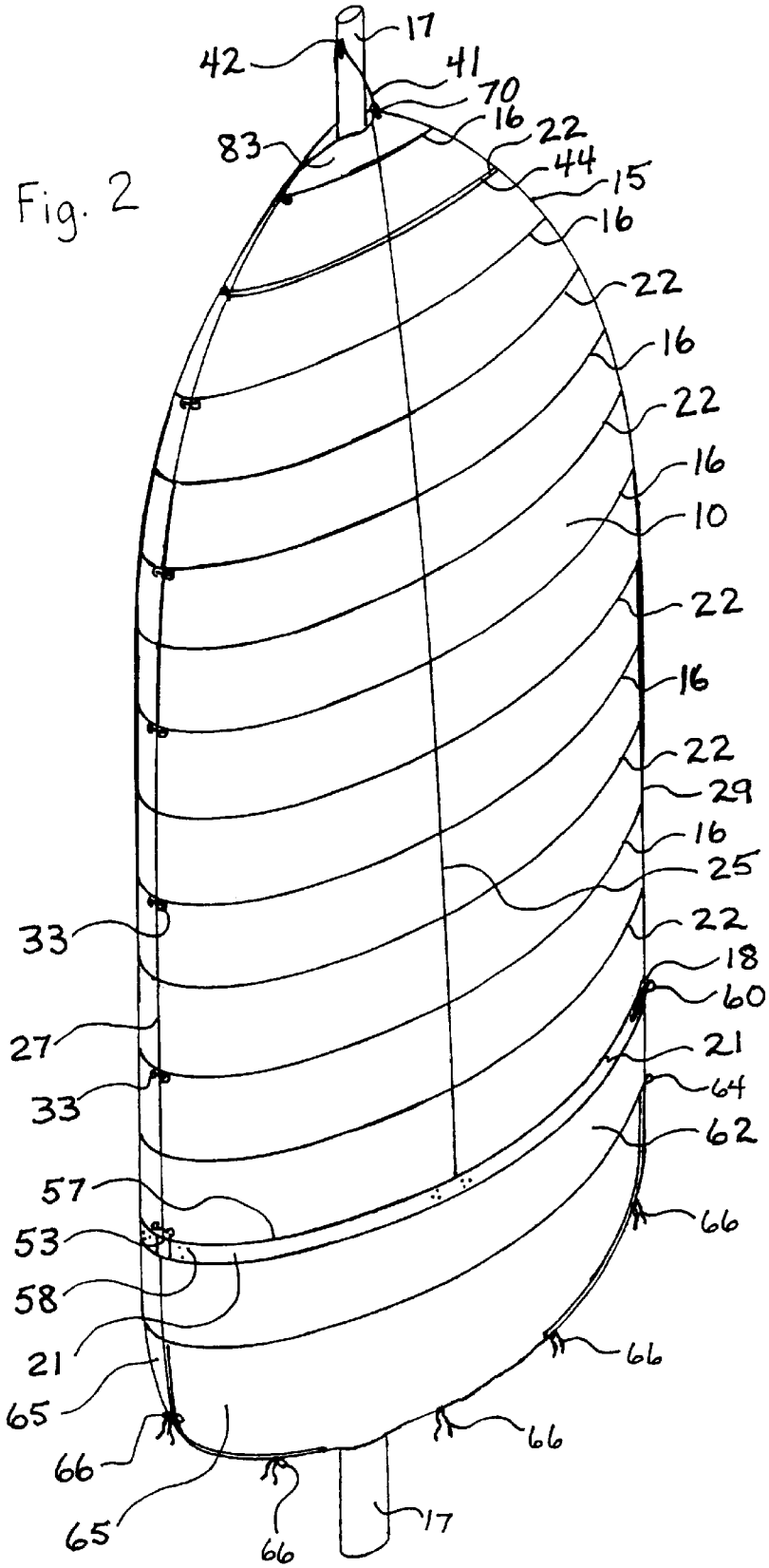

FIG. 2 shows a forward perspective view of a stowable wing.

Figure 2A:
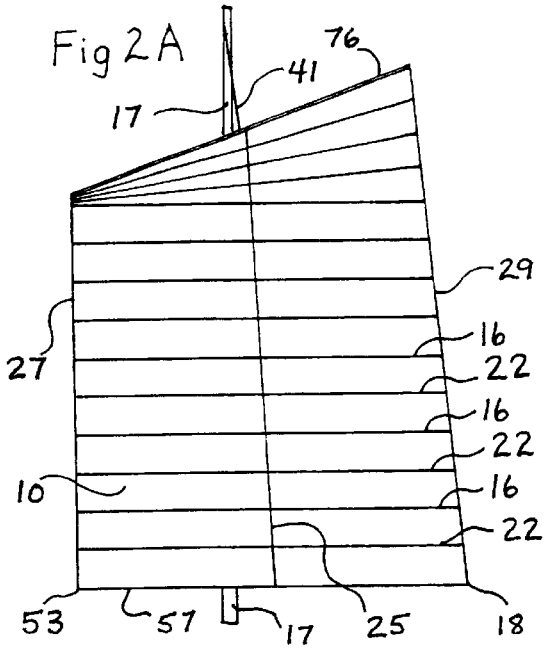

FIG. 2A shows a side view of a gaff rigged wing sail.

Figure 2B:
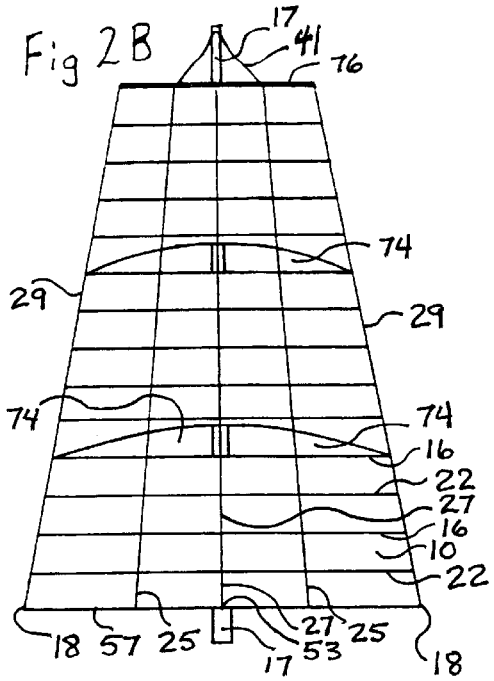

FIG. 2B shows a side view of a square rigged wing sail opened as a spinnaker sail.

Figure 2C:
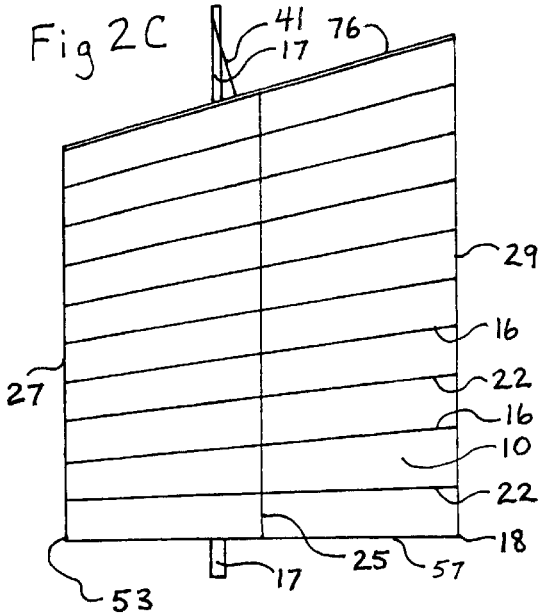

FIG. 2C shows a side view of a Chinese lug rigged wing sail.

Figure 2D:
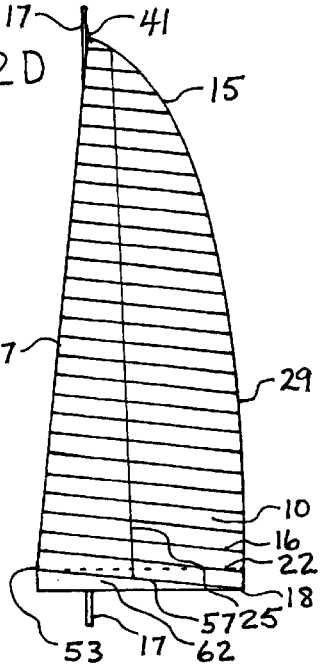

FIG. 2D shows a side view of a Bermudan rigged wing sail.

Figure 3:
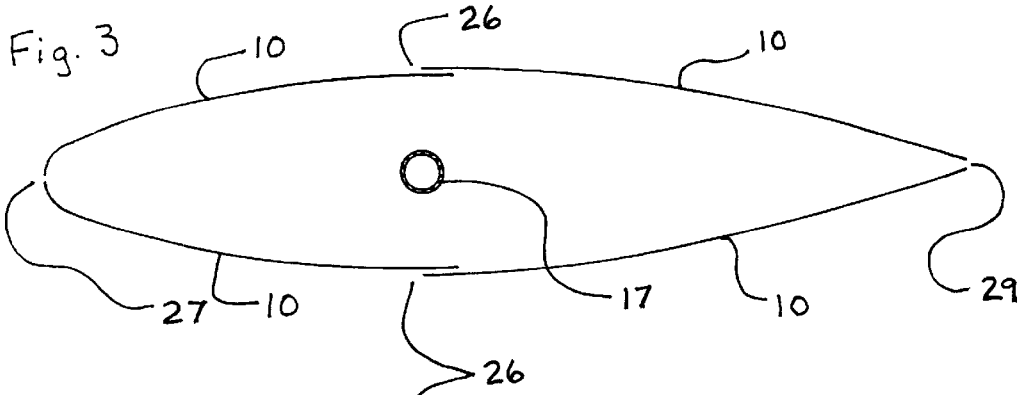

FIG. 3 shows a cross sectional view of an outside fold at full draft with slots.

Figure 3A:
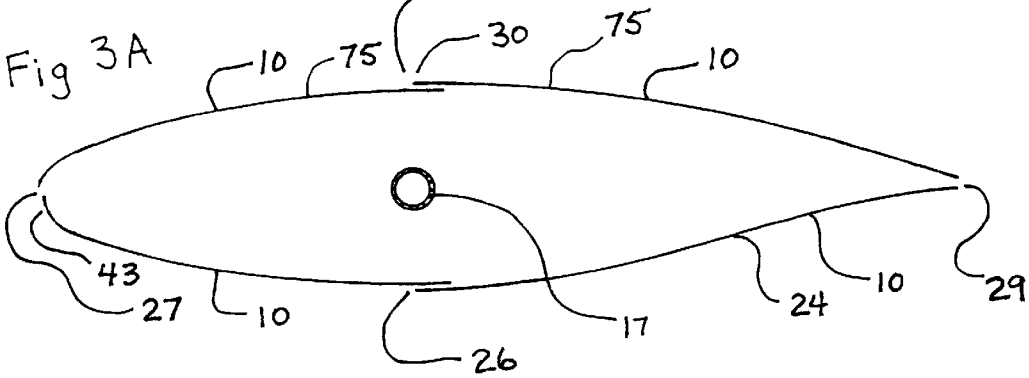

FIG. 3A shows a cross sectional view of FIG. 3 in an alternate movement with airflow applied to the forward left.

Figure 3B:
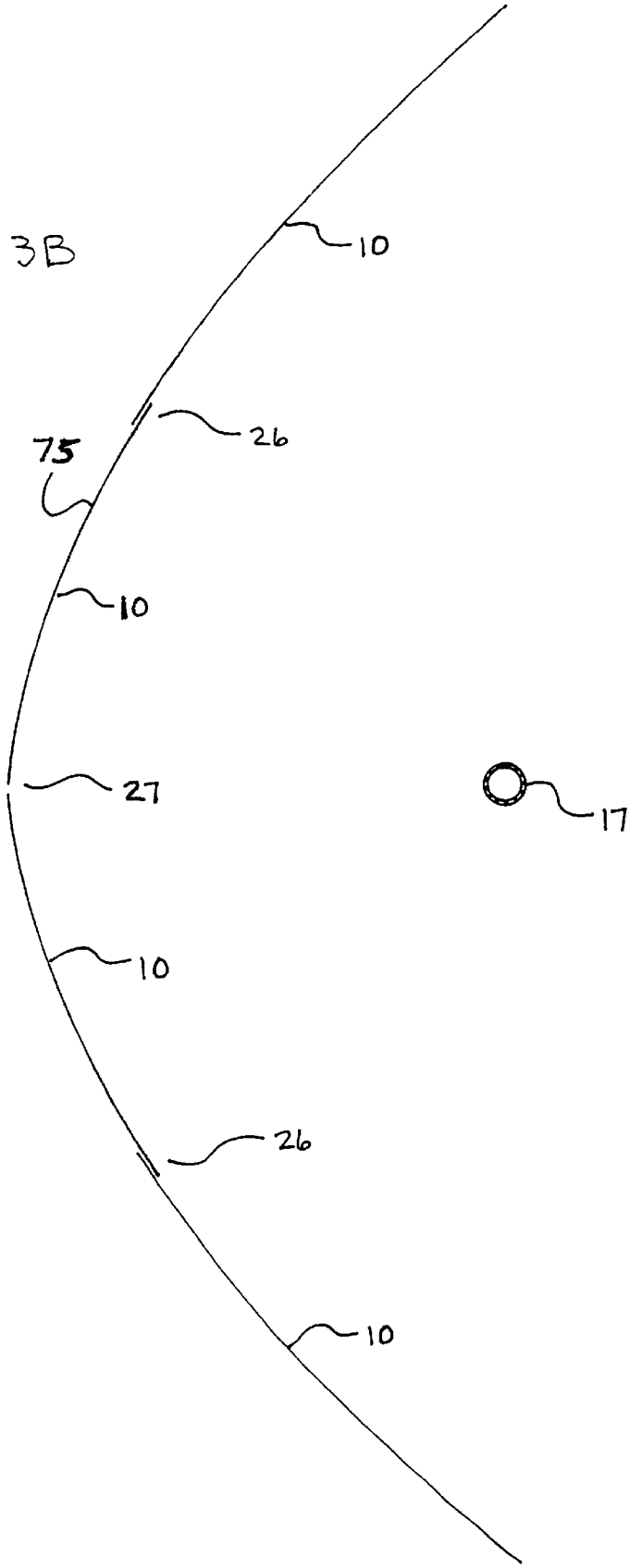

FIG. 3B shows a view of FIG. 3 in an alternate movement with airflow applied from behind.

Figure 4:
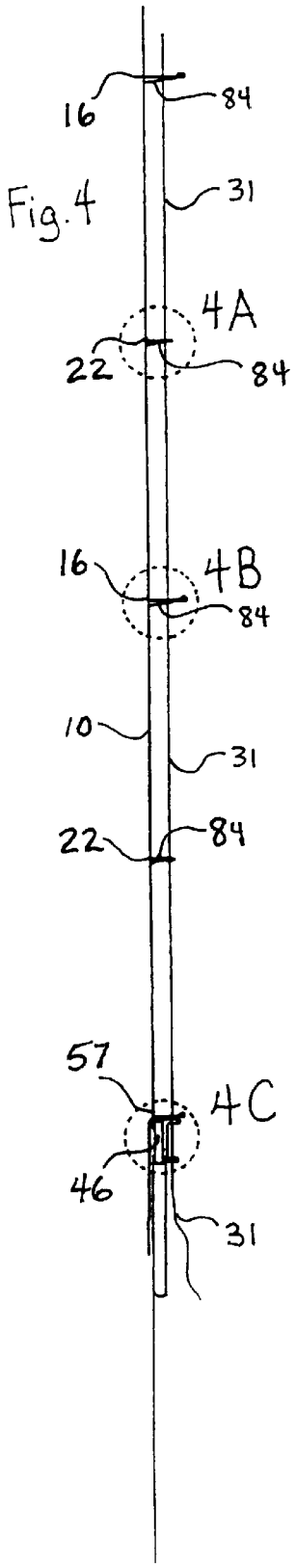

FIG. 4 shows a vertical cross section view through a downhaul position of a panel.

Figure 4A:
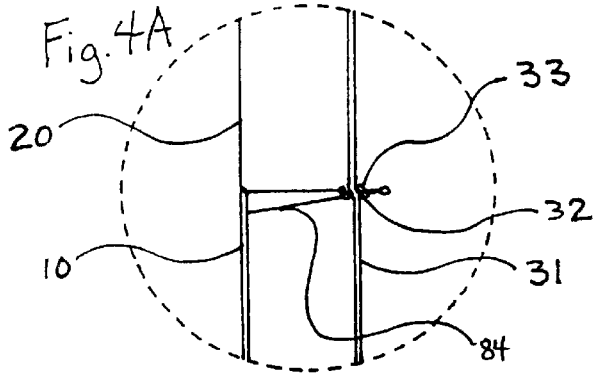

Detail FIG. 4A shows detail view of FIG. 4 with a jammed downhaul line at an inside fold.

Figure 4B:
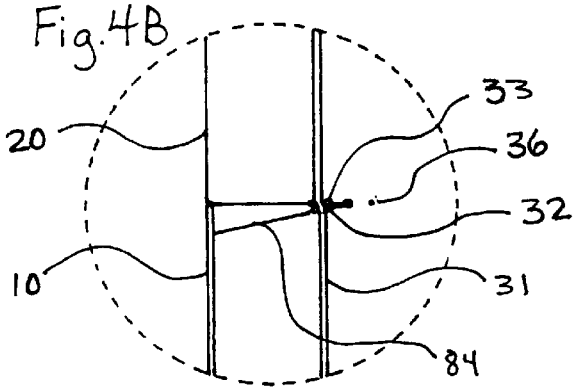

Detail FIG. 4B shows detail view of FIG. 4 with a jammed downhaul line at a reef position.

Figure 4C:
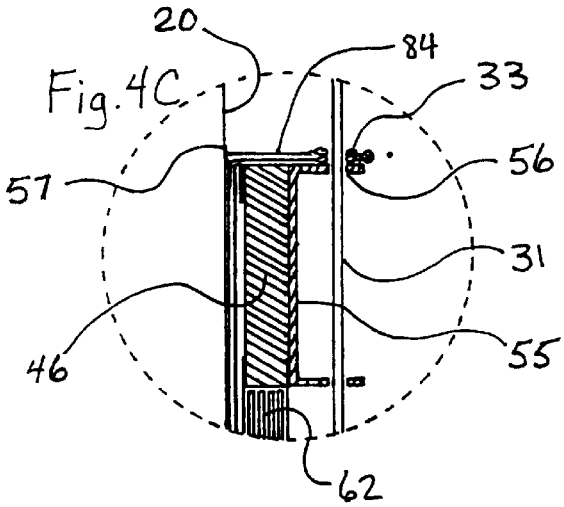

Detail FIG. 4C shows detail view of FIG. 4 with a freed downhaul line at the boom.

Figure 5:
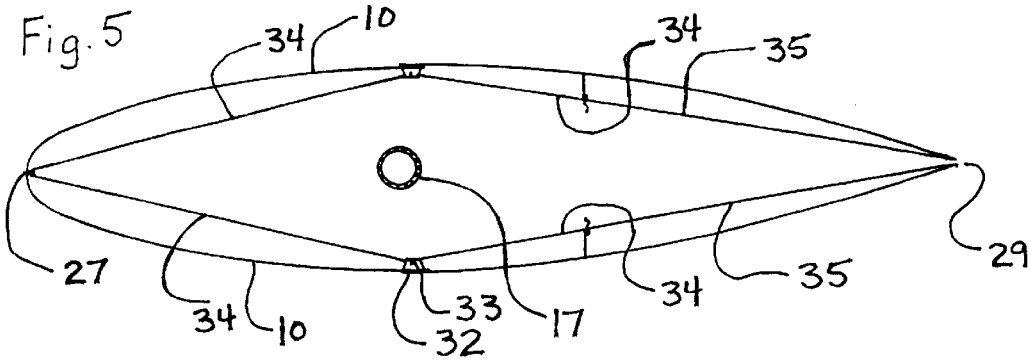

FIG. 5 shows a cross sectional view of wing sail inside fold with shape control springlines.

Figure 5A:
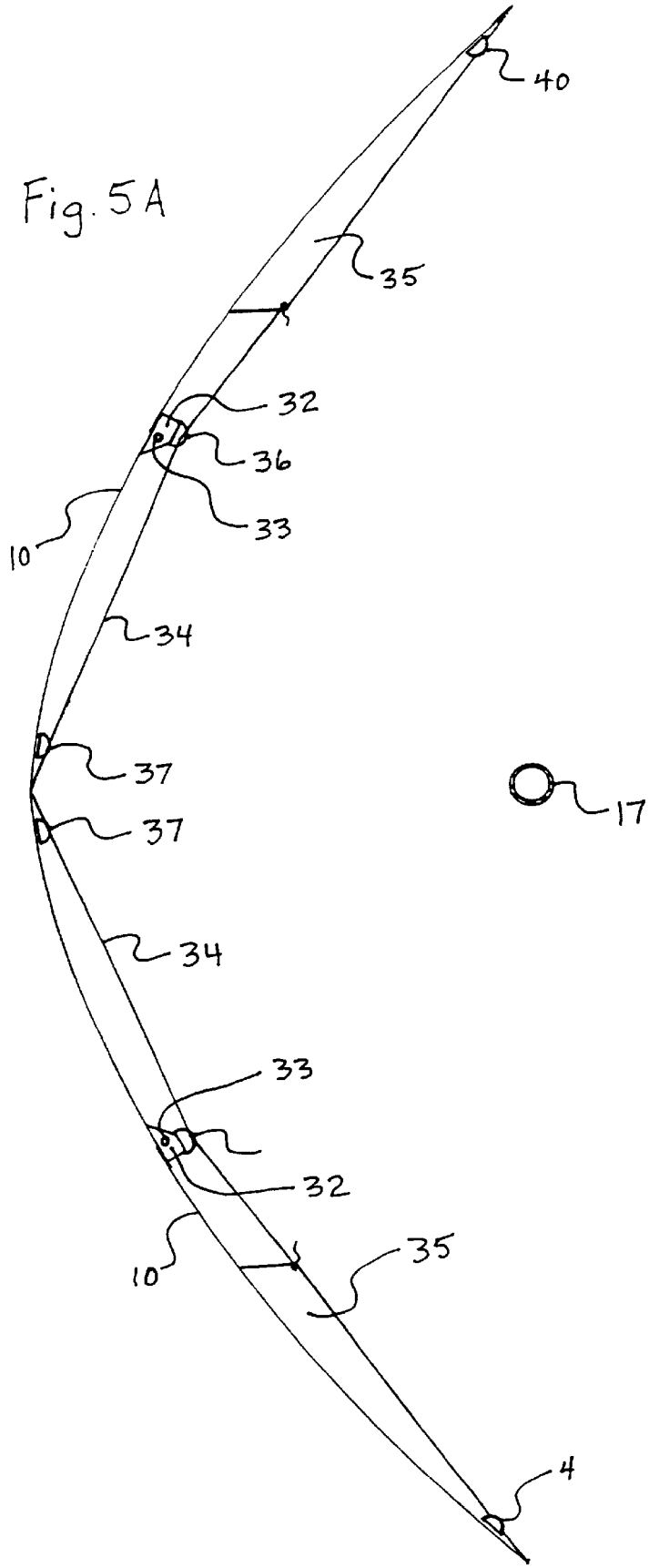

FIG. 5A shows a cross sectional view of spinnaker sail as an alternate movement of FIG. 5.

Figure 6:
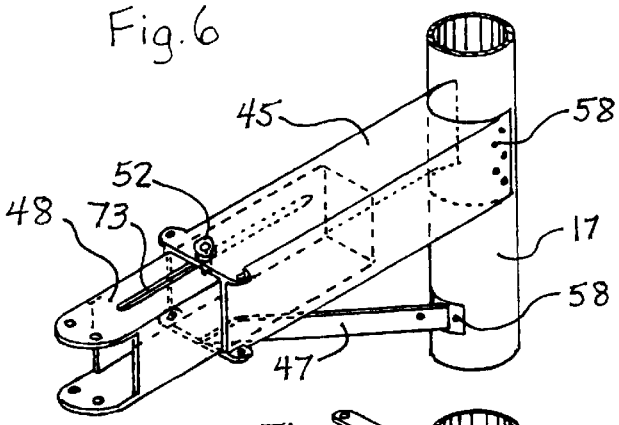

FIG. 6 shows a perspective view of a mast section with attached foreboom, foreboom brace, and extending boom with eyebolt.

Figure 6F:
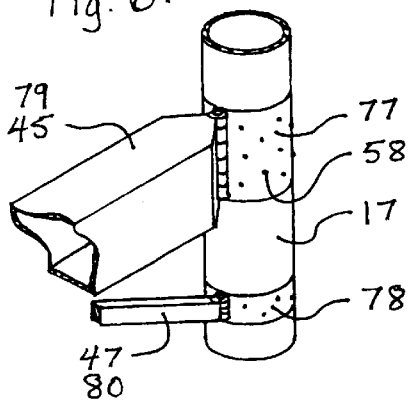
Figure 6A:
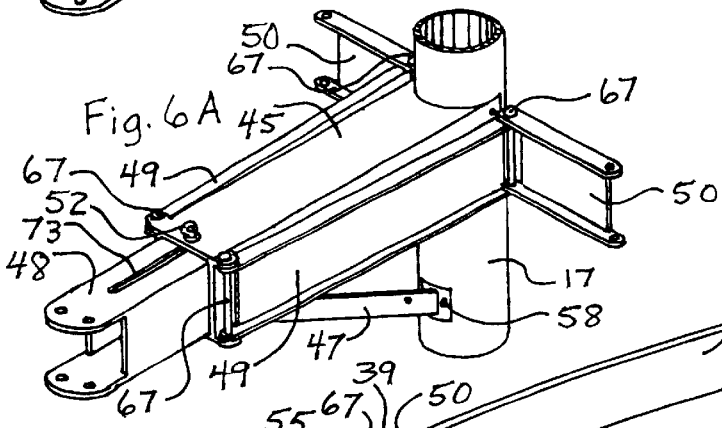

FIG. 6A shows FIG. 6 with addition of spinnaker and draft arms attached with pins.

Figure 6B:
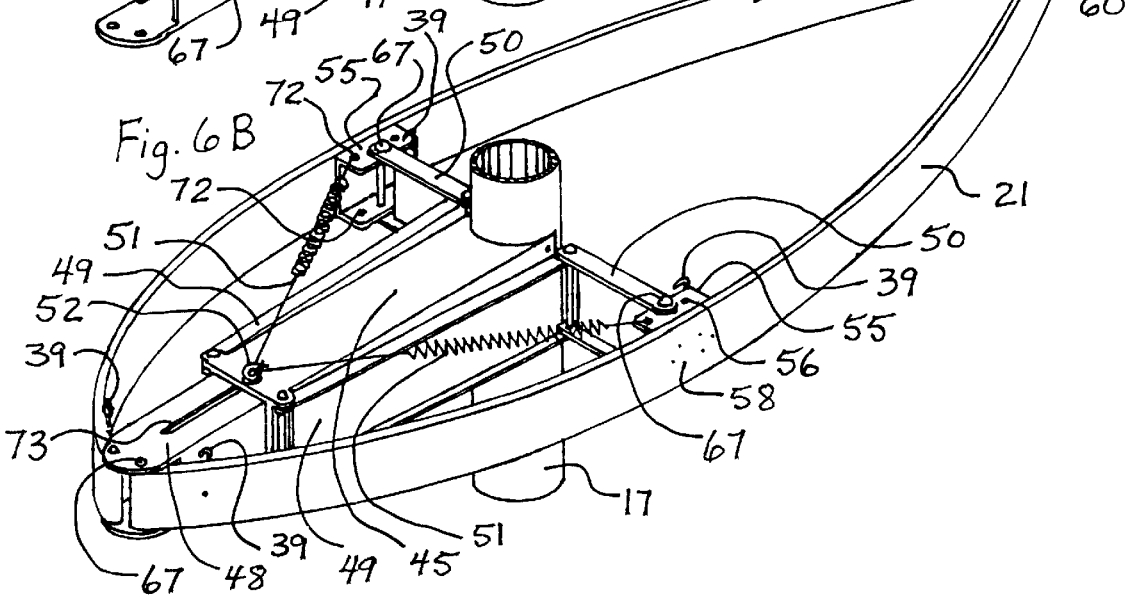

FIG. 6B shows FIG. 6A with addition of full draft booms attached by pins and coil springs.

Figure 6C:
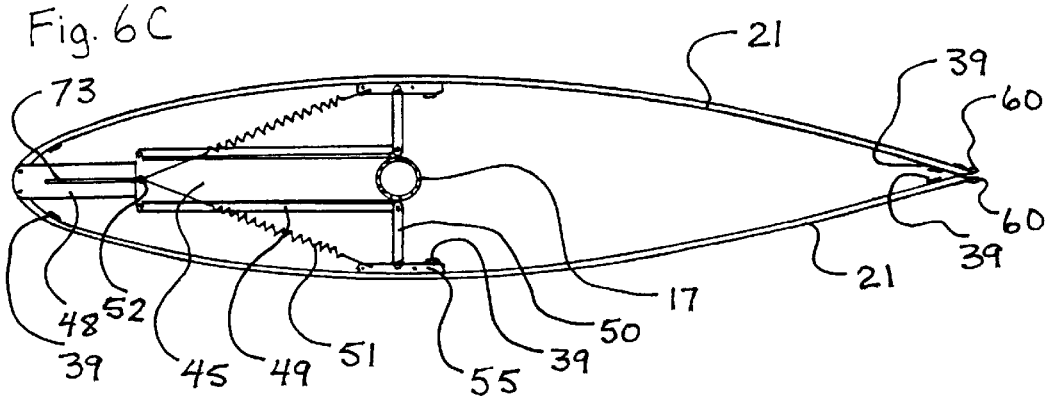

FIG. 6C shows a top view of full draft boom of FIG. 6B.

Figure 6D:
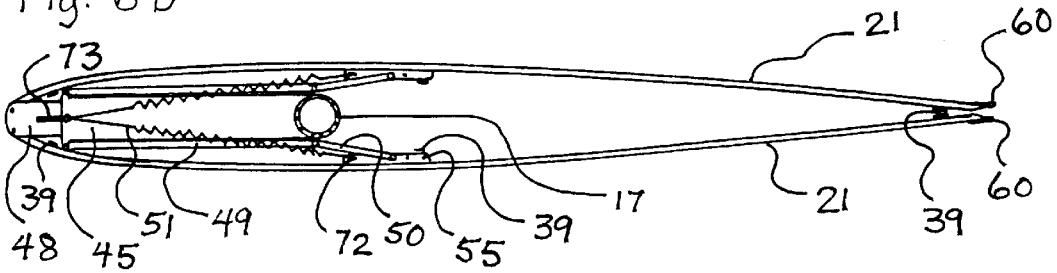

FIG. 6D shows a top view of minimum draft boom, alternate movement of FIG. 6C.

Figure 6E:
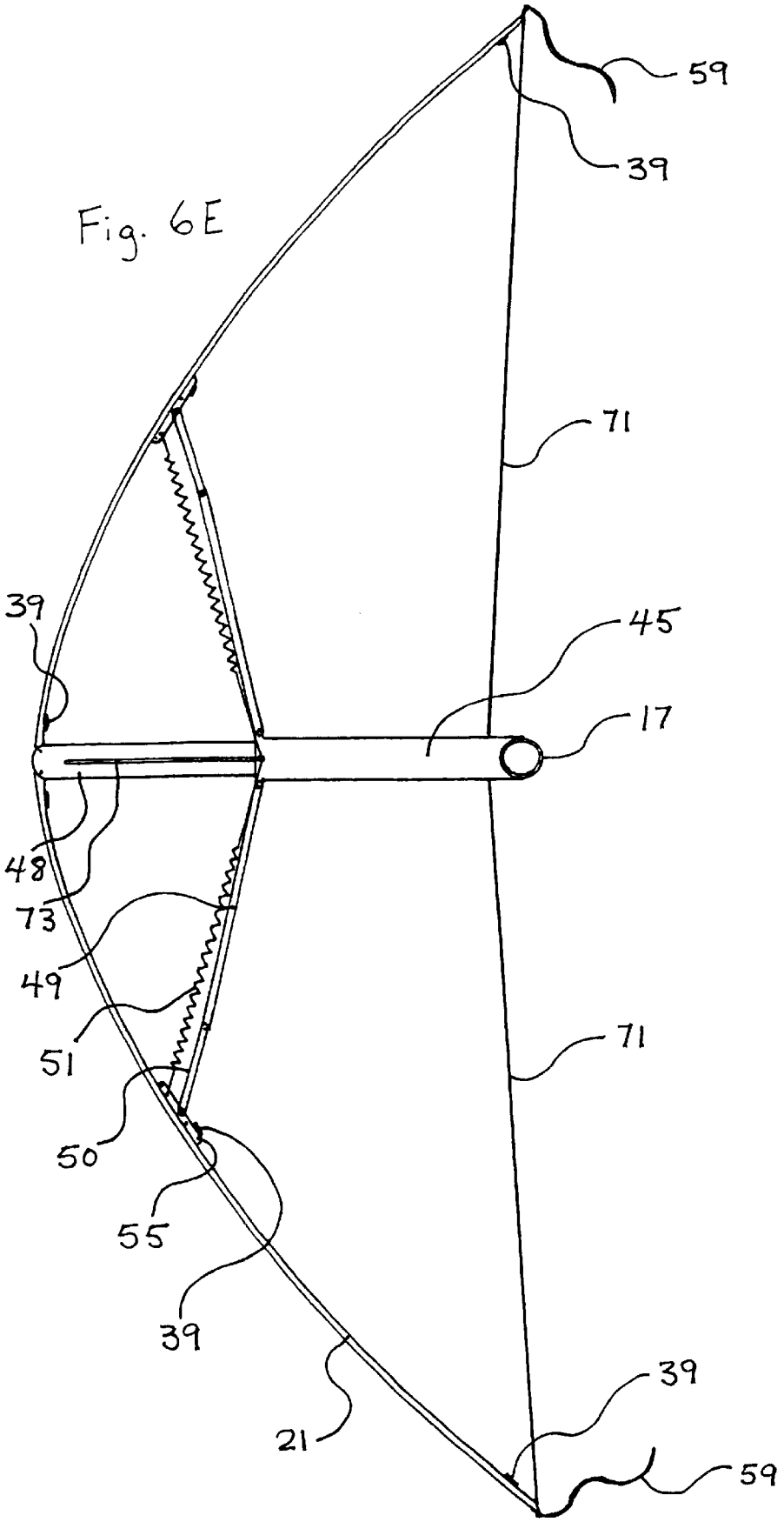

FIG. 6E shows a top view of spinnaker sail boom, alternate movement of FIG. 6C.

FIG. 6F shows a view of FIG. 6F with alternate foreboom and brace goosenecks fitted to bands.

Figures 7, 7A, 7B, 7C, 7D, 7E, 7F, 7G, 7H, 7I:
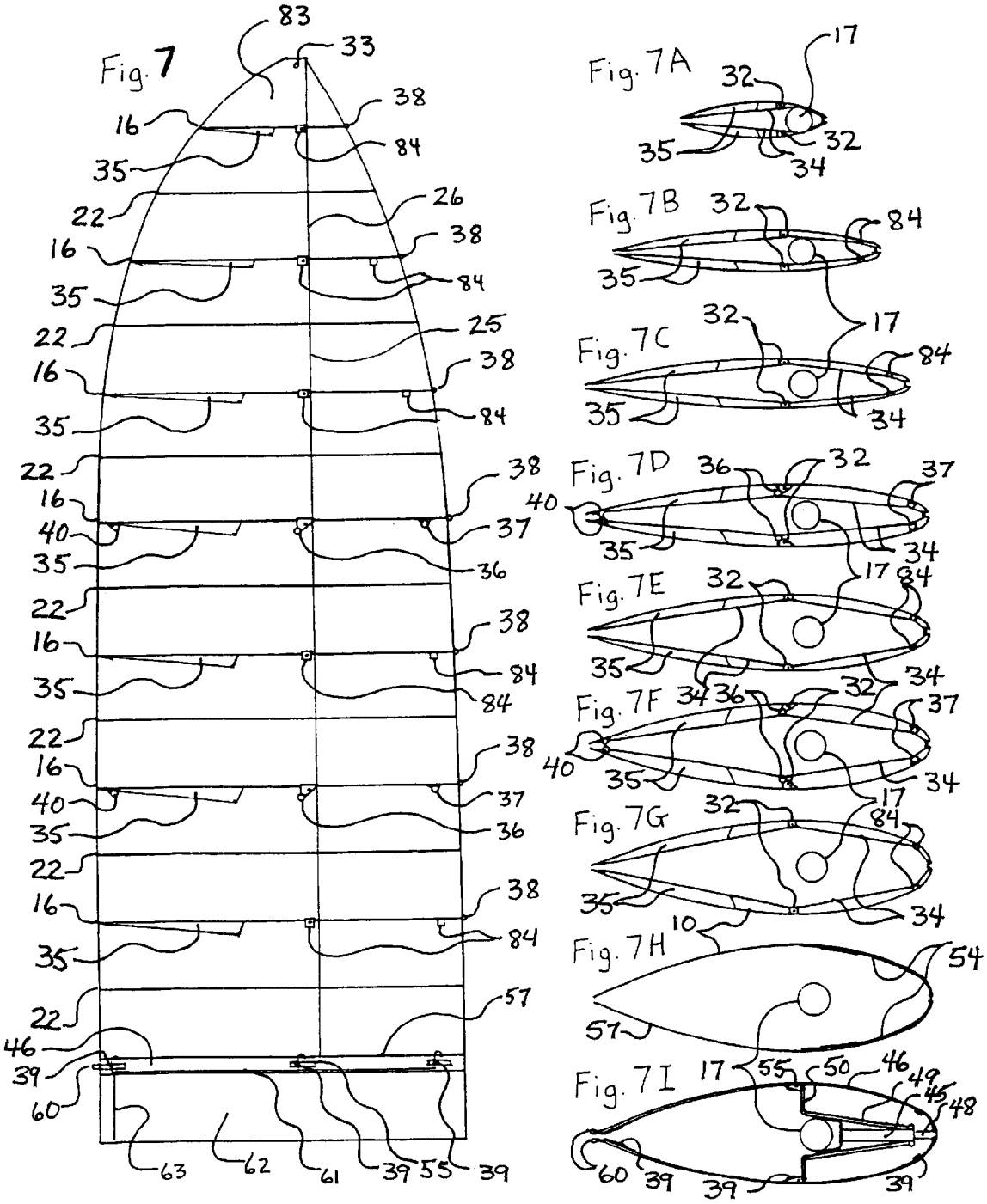

FIG. 7 shows a side view of interior of port panel.

FIGS. 7A through 7I show cross sectional views of wing interior.

Figures 8, 8A, 8B:
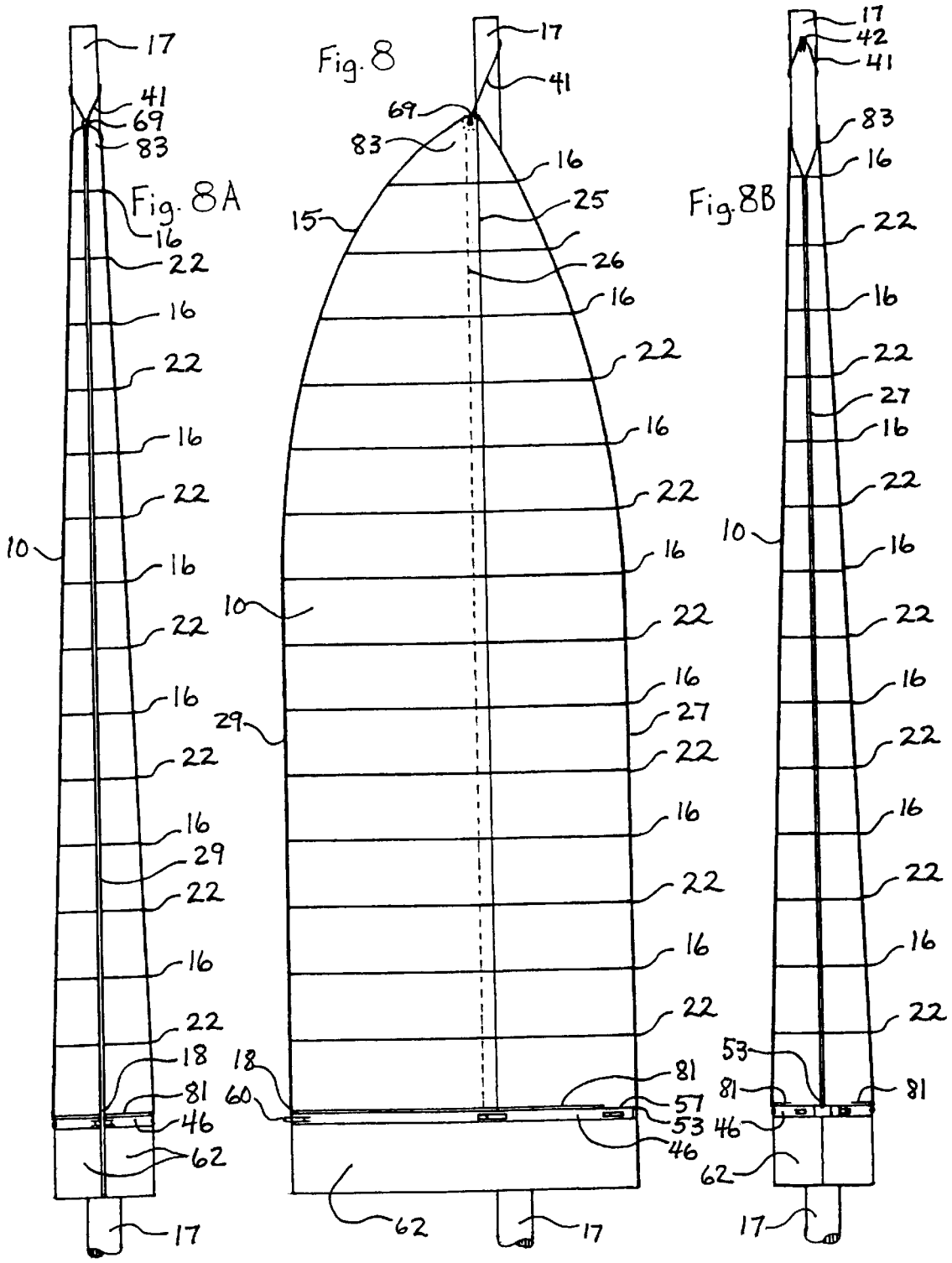

FIG. 8 shows a side view of starboard side of wing.

FIG. 8A shows an end view from back of wing.

FIG. 8B shows an end view from front of wing.

Figures 8C, 8D, 8E:
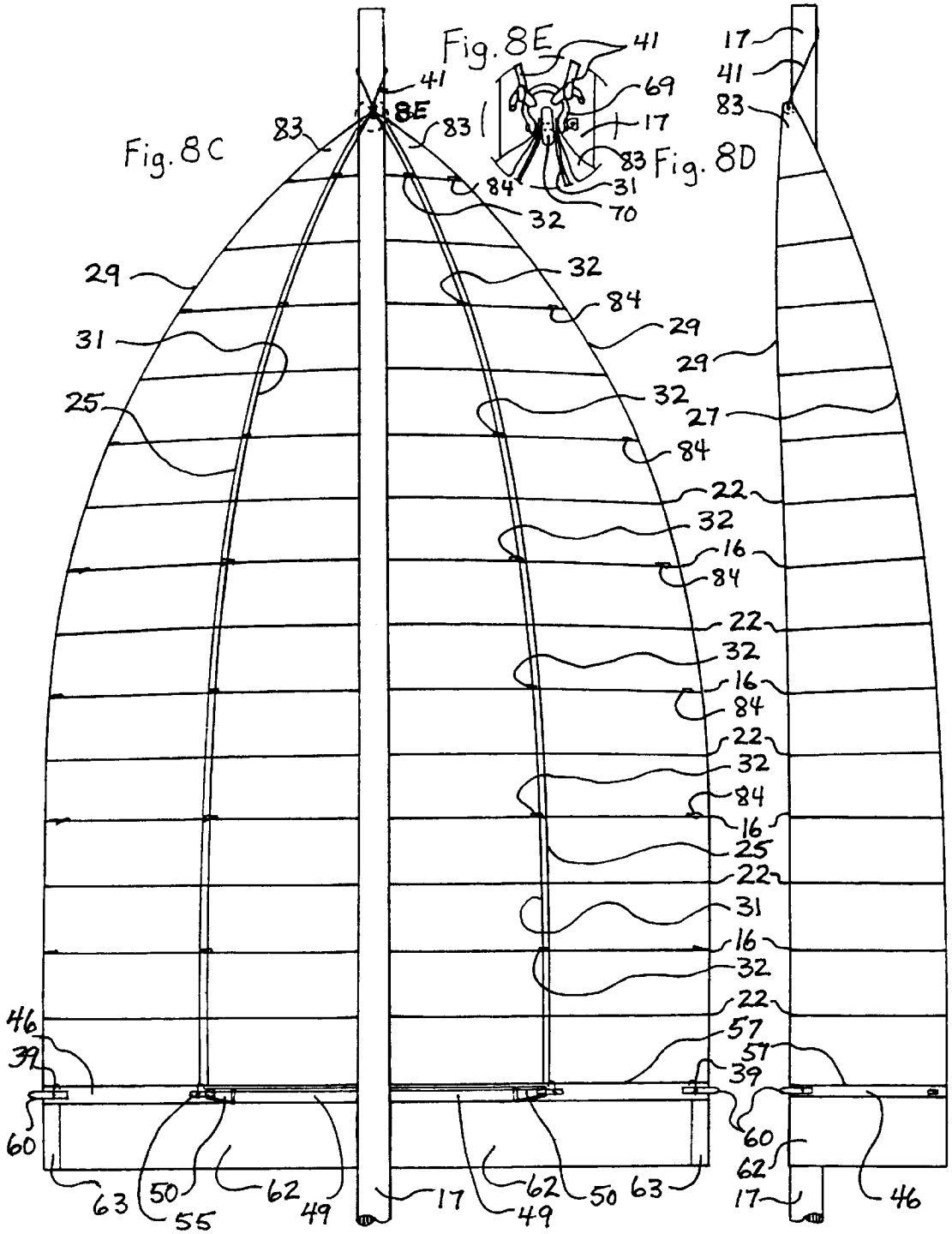

FIG. 8C shows a view from back of opened wing.

FIG. 8D shows a side view from starboard of opened wing.

Detail FIG. 8E shows detail of headboard roller.

Figures 9, 9A, 9B, 9C, 9D, 9E, 9F:
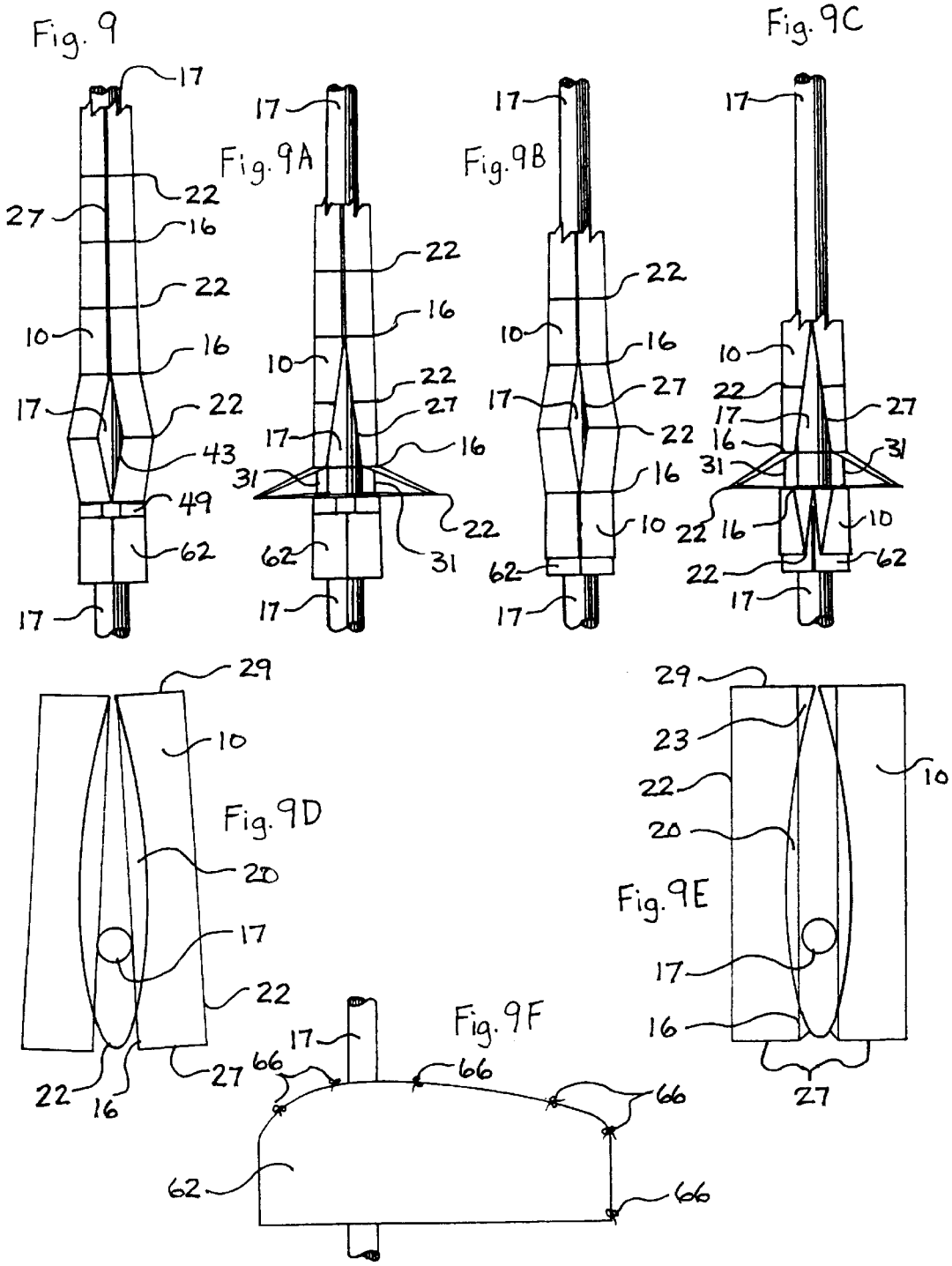

FIG. 9 shows an end view from front of wing beginning to fold first panel

FIG. 9A shows an end view from front of wing with first panel halfway folded.

FIG. 9B shows an end view from front of wing with second panels beginning to fold.

FIG. 9C shows a view from front t of wing with second panels halfway folded.

FIG. 9D shows a view of cross section of 9A.

FIG. 9E shows a view of cross section of 9C.

FIG. 9F shows a side view of a stowed wing sail.

REFERENCE NUMERALS IN DRAWINGS

| | |
|---|---|
| 10 | sail panel |
| 11 | foam core |
| 12 | sailcloth |
| 13 | panel section |
| 14 | core fold gap |
| 15 | full roach |
| 16 | inside fold |
| 17 | mast |
| 18 | clew |
| 19 | spinnaker sail |
| 20 | fold core cut |

-continued 21 airfoil shaped boom
22 outside fold
23 low stall core cutout
24 concave depression
25 span wise slot
26 slot overlap
27 luff
28 windward slot
29 leach
30 leeward slot
31 downhaul line
32 downhaul jam
33 grommet
34 shape control springline
35 extended leach tab
36 midchord reef ring
37 tack reef ring
38 tack grommet
39 reef hook
40 clew reef ring
41 halyard
42 sheave
43 spread luff
44 batten in sleeve
45 foreboom
46 boom
47 foreboom brace
48 extending boom
49 spinnaker arm
50 draft control arm
51 coil spring
52 boom eyebolt
53 tack
54 tack springline
55 boom pad eye
56 guide hole
57 sail panel foot
58 screw
59 sheet
60 boom cap bail
61 reef hook release line
62 spare sail pocket
63 spare sail access flap
64 pocket clew loop
65 sail cover
66 sail cover lanyard
67 bolt pin
68 sailcloth peeled back
69 shackle
70 headboard roller
71 boom vang
72 forward pad eye hole
73 foreboom slot
74 clear window
75 leeward surface
76 sprit boom
77 fixed foreboom band
78 fixed brace band
79 foreboom gooseneck
80 brace gooseneck
81 backer strip end
82 partial wing shape
83 headboard
84 sailcloth tabs

DESCRIPTION OF INVENTION

Drawing Sheets 1 thru 15—Preferred Embodiment

The stowable wings' semi rigid sail panels (FIG. 1) 10 are produced with a thin foam core 11. The closed cell foam cores' material is "noncrosslinked polyvinyl chloride foam". The PVC foam core is known by its trademarked name as Airex, and is available from Torin Inc., 9 Industrial Park, Waldwick, N.J. 07463. The core has a memory shape characteristic, after bending it returns to its original shape. These sail panels' interior and exterior surfaces are laminates of "lightweight sail makers' materials" 12. The laminated sailcloth provides a smooth, durable surface that is ultraviolet protection for the core. The strength of the individual panel materials is increased substantially by lamination. This allows the decrease in the thickness and weight of the materials, required for the strength of this wing sail panel. The manufacture (lofting) of the sail panels is accomplished with the use of laminating adhesive. The major change in the process of lofting the stowable wing panels, from standard sail lofting, is the addition of foam core.

Major sail rigging manufacturers such as Hood StoWay Yachtspars, Portsmouth, R.I., or sail manufacturers such as North Sails, San Diego, Calif., can supply the materials, and specific technical expertise required for lofting these sails.

The stowable wings' whole sail panels 10 are lofted with the core being, "multiple horizontal panel sections" 13. The core panel sections are spaced with a small gap, or groove between their top and bottom edges 14. This is for the sail panels to fold where they are gapped. The sail panels are made of two vertical sections (FIGS. 1A and 1B). The vertical trailing section (FIG. 1B) overlaps the exterior of the vertical leading edge section (FIG. 1A), and they are stitched together at their inside folds 16.

The stowable wing is formed of "inversely twin sail panels". The best outline shape of the stowable wing, would be "round headed full roach" (FIG. 2) 15. However, it can be designed aesthetically, to replace any of the more traditional outline shapes. Such as, the Gaff rig (FIG. 2A), the Square sail rig (FIG. 2B), the Chinese lug rig (FIG. 2C), and the Bermudan rig (FIG. 2D). This would increase the efficient use of the wind power for those shapes.

The stowable wing is assembled, by attaching the foot of the sail panels 57 with a backer strip 47, and screws 58 to their respective sides of the boom 46. The backer strip extends from the clew of the booms, to a point close to the tack of the booms 81. The backer strips not continuing to the tack, is to facilitate the folding of the foot panels at the tack, as the panels need to unbend and rebend, to fold down. Next, the leading edges of the sail panels are joined together, with the shape control springlines 34, (FIG. 5) at the inside folds' 16 leading edge grommets 33.

Then by hoisting the sail panels with the halyard 41 from the "airfoil shaped boom" 21, a wing sail is formed surrounding the mast 17 as a backbone. The boom parts the sail panels at the clews 18 (FIG. 6E), forming a spinnaker sail 19 in front of the mast (FIG. 8D). The "rounded head shape" of the wing sail panels, have an additional advantage for its selection in the preferred embodiment. The "rounded full roach" forms a "spinnaker sail shape", with the dual panels parted (FIG. 8C).

A significant improvement over other wing sails, is the stowable wings' ability to reef (fold down) its panels easily. To facilitate this, the foam core, is cut, thinned or voided at the bottom of each panel section (FIGS. 1A, 1B,) 20, that folds down. Which is the upper panel of two panel sections making an inside fold 16.

The shape of this cut is an upward cambered curve close to the shape of the full draft boom 82 (FIGS. 9D, 9E). This softer panel area eases the folding of the "cambered rigid panels", over the booms' airfoil shape 21.

Another softer panel section also aids in the folding down of the rigid panels, the foam core is cutout, or thinned 23 (FIG. 1B, 1C) in half elliptical shapes. The soft panel side section is along the outside fold 22 cross section areas, beginning at the midchord section of the wing sail panel area, to the trailing edge. An additional purpose for this core thinning is to form a windward concave depression 24 (FIG. 3A). This speeds up the flow of wind leaving the windward side of the wing sail. Which essentially, creates a wing with a lower stall speed.

Each of the stowable wings' sail panels has a span wise slot 25 (FIG. 2) at forty five percent abaft the leading edge. The trailing part of the sail panel, overlaps the leading part of the sail panel at these slots (FIG. 3, 3A, 3B) 26. The slots are joined together at every inside fold (FIG. 5). The outside fold is allowed to expand the slot by the force of the airflow on it (FIGS. 3, 3A). The slots remove an amount of air equal to the disturbed boundary layer, at the same rate of speed as the air is flowing. On either tack, the wing sail panels' slots function alike. In aerodynamic terms, the slots are referred to as a "high lift device".

The port and starboard sail panels fold simultaneously. The stowable wing remains an airfoil in use when raising or stowing the panels (FIG's. 9, 9A). This is for optimum performance while changing the amount of sail area exposed to the wind. The stowable wing downhaul lines (FIG. 4) 31, extend from their attachment at the headboard 83, through downhaul jams 32 and the boom pad eye 55 guide hole 56, to the cockpit of the craft. The downhaul line material is a low stretch polyester (rope). The downhaul jams keep the upper panels in flat sections by being clutched in downhaul jams 32 (FIG. 4A). The downhaul jams are sailcloth tabs 84, with two grommets 33, and are located at each inside folds' midsection (FIGS. 5A, and 7A thru 7G).

The grommets 33 of the jam are misaligned to grip the downhaul line (FIG. 4B). The grommets release the downhaul line upon reaching the boom, by becoming aligned (FIG. 4C). The two part sail panel section above the freed line is then allowed to fold down. The grommets' material can be brass, stainless steel, neoprene rubber, or nylon.

Shape control springlines 34 (FIG. 5, 5A, and FIGS. 7A thru 7G) are located horizontally along each of the inside fold sections of the sail panels. They bend the sail panels' draft outward, and the leading edges (luff) in an elliptical shape, and are the adjustment for camber of the sail panels. The shape control springline is attached to the "foam cored extended leach tab" 35, and led through the midchord reef ring 36. From the midchord ring the line is led through the tack reef ring 37, and threaded through a grommet 38 at the luff of both sail panels (FIG. 2). The line is then led through the reef rings of the other panel, to its extended leach tab. The springline keeps the dual panels leading edges in line with, and close to each other. The cambered tack 53 at the foot of the sail panel, which needs to straighten out for reefing, is secured with a shorter springline 54 from the boom midsection pad eye 72. The downhaul jams are held out in tension by these springlines.

At reefing positions, the springlines are run through the reef rings, for their alignment with reef hooks 39. The reef rings hold their downhaul jams out in tension (FIG. 7G). The extended leach tab is for tensioning the clew reef rings 40 for alignment with their reef hooks, and to keep from bending too much camber in the flexible trailing area of wing sail panel.

The stowable wing requires a freestanding spar (mast) 17 for its operation. This is to eliminate the complexity of the design that would be needed to work around standing rigging and spreaders.

The heads of both stowable wing sail panels are joined together abaft the mast by a shackle 69 to dual halyards 41. Between the sail panel's heads, there is a headboard roller 70 (Detail FIG. 8E), which reduces the friction of the shackle against the mast. The shackle 69, attaches the head of the panels on each side of the roller. The halyards are led about the mast port and starboard, from sheaves 42 in the fore of the mast.

The head of the sail panels are battened 44 (FIG. 1A) to hold the rounded roach shape out fore and aft of the mast to extend the catenary lines (lines of force between the boom and head of sail). This places the forward catenary line of force close to the leading edge of the wing sail. Which makes the luff (leading edge) more rigid, in its hoisted tension from the boom.

The stowable wing panels enclose the mast as a backbone, and their alignment across the mast is balanced for easier and safer handling of the wing sail system. At full draft, the mast is situated abaft the leading edge, at forty percent of the wing sails' chord.

Which, for light winds, the leverage of the sail panels' trailing section to the forward section is, one and a half times (FIGS. 6C, and 7I). At minimum draft, the mast is situated abaft the leading edge, at thirty percent of the wing sails' chord (FIG. 6D). Which, for higher winds, the leverage of the sail panels' trailing section to the forward section is, two and a third times. Additionally, the wing sails' forward position places its' center of effort closer to the location for which an existing mast, was designed for on most sailing craft.

The stowable wing has a foreboom 45 (FIG. 6), that swings about in front of the mast. For the foreboom to be installed on a sailing craft with a fully rotating mast, the foreboom is attached with screws 58, as shown in (FIG. 6). For the foreboom to be installed on a craft with a nonrotating mast, the fixed foreboom band 77, and brace band 78 (FIGS. 6F) are attached with screws 58 to the mast. The foreboom and foreboom brace gooseneck fittings 79 and 80, are attached to the fixed foreboom bands with pins 67.

The twin flexible booms 46 (FIG. 6B) are jointed to swing backward in the form a wing, or open as the shape of the foot of a spinnaker (FIG. 6 E). The booms' jointed forward ends are mounted with a pin 67, to the end of an extending boom 48 that slides fore and aft in the foreboom 45. The extension boom has a lengthwise slot 73 (FIG. 6) in its top surface that, in communication with an eyebolt 52 in the top of the fore boom, keeps the extension boom from sliding out of the fore boom. The booms form the sail panels into an elliptical leading edge when bent backward into an airfoil shape. At the wing sails widest draft, the booms are supported off of the fore boom, port and starboard, by articulated control arms (FIG. 6A), which consist of the spinnaker extension arms 49 that are jointed off of each side of the fore booms' forward end, and the draft control arms 50 that are jointed off of the spinnaker extension arms. The draft control arms ends are jointed to the booms' 46 (FIG. 6B) pad eyes 55, and all the joints are secured with pins 67.

Coil springs 51 are connected between the booms' pad eyes 55, and the fore booms' eyebolt 52. The coil springs are the tension for joining the booms together in a wing shape, and for keeping the extending boom, and draft control booms forward. The spinnaker setting is the strongest tension on the springs (FIG. 6E), and the least tension is the full draft wing shape (FIG. 6C). Additionally, the booms are formed in the full draft shape, to provide springability against the minimum draft shape (FIG. 6D).

Therefore, less airflow is required to open the spinnaker, than to reduce the draft of the wing. Because the airfoil presents less area to the airflow, when used in a wing shape, than it does as a spinnaker shape.

The materials for the moving parts of the boom can be aluminum, steel, carbon fiber, or fiber reinforced plastic. Materials for parts change with the size of the sail, and mounting structure, for a particular size of sailing craft. The coil springs are steel, and the booms are wood, laminated wood, carbon fiber, or fiber reinforced plastic. The springlines are bungee cords.

A pad eye 55 (FIG. 6B) is mounted on the inside of each boom, port and starboard, at forty percent abaft the leading edge. The pad eyes are for jointed attachment of the draft adjust control arms. A guide hole 56 in each pad eye is for the downhaul lines to correctly align the sail panels as they are folded down. The pad eye has a hole 72 at its forward end, and is for the connection of the tack springline 54 (FIG. 7H), and for hooking of the coil spring. Also, the midsection reef hooks are attached to the after end of these pad eyes, to align them with the reef rings.

The possibility of breaking one of the booms when in the spinnaker sail setting, is eliminated with boom vang lines 71 (FIG. 6E), which limit the boom ends from lifting, or bending too far. Each vang line is attached from its respective boom cap bail 60, to the fore boom bottom brace (FIG. 6) 47. Thereby, making it possible to use the spinnaker sail without sheets at the clews.

Located along the inside of the booms are reef hooks 39 that, hook on reef rings attached to the sail panels midsection downhaul jams 36, and on reef rings at the tack 37, and clew 40. A spring loaded line (FIG. 8C) 61 keeps all reef hooks fastened; the opposite end of that line is led to the cockpit for releasing the hooks.

Attached below each boom, a pocket of sailcloth 62 (FIGS. 2, 4) is for stowage of spare folded sail panels. The folded rigid panels would not be handily stowed elsewhere. The twin stowage pockets are joined together at their leading edges. The spare sail stowage pockets increase the total sail area, and the booms unilateral strength.

A dual panel sail cover (FIGS. 2, 4) 65, when not protecting the stowed sail folds down. The cover closes the opening at the foot of the wing sail, to prevent over ventilating the interior of the wing sail.

The lashed panels of the cover 66 round the foot of the wing sails' leading and trailing edges, for a decrease of induced drag. The cover has a batten 44 in each of its fabric panels at their leading and trailing edges, which keeps the covers shaped.

Different sized wing sails require different strengths of materials, which translates to different weights of materials. The following is an example of the lightweight characteristics of a medium aspect ratio (span to chord ratio), eight meter high stowable wing;

The foam core at the head of the sail panels for this example, is a nine pound per cubic foot density, the midsection sail panels are six pound density, and half of the total sail area; toward the foot sections are four pound density. The softer sections are not cored thinner; they are voided of core material. Because of the core voids, this sail panel's area is fifty five percent cored, at 3.25 mm. thick. The span wise slots luff (leading edge) and leach (trailing edge) of the sail panels have extra reinforcing with a highly oriented aramid fiber material.

With 9 pounds per cubic foot foam density, at the sail head sections, and laminates of 1.5 ounces of sailcloth on each side, these panel sections' weight is 8.87 ounces per sail makers yard.

With 6 pounds per cubic foot foam density, at the mid-sail sections, and laminates of one ounce sailcloth on each side, this panel sections' weight is 5.91 ounces per sail makers' yard.

With 4 pounds per cubic foot foam density, at the lower sail panel sections, and laminates of half ounce sailcloth on each side, these panel sections' weight is 3.6 ounces per sail makers yard.

Considering the reduced area of the head of the sail, the fold core reduction, and the three differently weighted sections, the average overall weight of the entire sail panel per square sail makers' yard is 3.98 ounces. Thus, the average overall weight of the stowable wing by multiplying the dual sail panels is, 7.96 ounces per square sail makers' yard.

The dual paneled stowable wing that replaces the main, jib, and spinnaker sails, is comparable in weight aloft to a regular single panel eight ounce mainsail. Therefore, with similar weight considerations, the stowable wing significantly increases power from the wind, for sailing craft. This includes the weight of dual panels having a fully rigid leading section, and a trailing section fully battened with foam core.

My lightweight Stowable Semi Rigid Wing Sail System is a significant improvement over all other airfoils for wind powered craft, with its multiple sail shape settings, automatic draft adjustment, drag reductions, and high lift devices. Thus, all useable wind conditions can be utilized for one hundred percent efficient use of the winds' power.

FIGS. 2A–2D—Additional Embodiments

Additional embodiments are shown in (FIGS. 2A, 2B, 2C, and 2D); in each case the slots, panel folding, downhauls, shape control lines, and boom arrangement with its automatic draft adjustment, and parting into a spinnaker sail, are typical of the preferred embodiment.

A gaff rig (FIG. 2A) wing sail is shown in its wing sail shape by the use of dual sprit booms 76 at the head of the sail.

A square rig (FIG. 2B) wing sail is shown in its spinnaker sail shape by the use of dual sprit booms 76 at the head of the sail. The foam cores are omitted in a cambered shape 74, representing the space between square sails. Clear MYLAR is laminated on each side of a SPECTRA webbing, in these core omission sections.

A Chinese lug rig (FIG. 2C) wing sail is shown in its wing sail shape by use of dual sprit booms 76 at the head of the sail.

A Bermudan rig (FIG. 2D) wing sail is shown in its wing sail shape with the foot boom arrangement angled over the stowage pockets, to facilitate easier folding of the panels.

Advantages

The stowable wing is a significant improvement over all other wings and sails, in its abilities for easy and safe operation;

(a) the dual wing panels fold down easily for reefing, or stowing.

(b) all sail trimming can be handled from the safety of the cockpit.

(c) when tacking, the mast brake controls the booms movement.

(d) the spinnaker set sail has a five point hitch at its foot, keeping the sail under control.

(e) increased efficiency has less sail area exposed to the wind, which reduces the risk of knockdown, by sudden strong bursts of wind.

(f) the efficiency of design, increases the righting arm, and lowers the centers of both gravity and effort, for less heeling of the craft.

(g) the foam cored panel's float, in case of heavy weather knockdown, which will help prevent rollover on sailboats.

(h) the wing sail setting can point closer to the upwind direction, thus making fewer tacks with the wing sail, for the sailing craft to arrive at a desired location.

The stowable wing reduces a higher percentage of drag vortices than other airfoils, and increases lifting power of the wing sail system by several measures;

(a) the fair cambered smooth semi rigid panels, improve boundary layer flow at all sail settings.

(b) the span wise midchord slots, combined with the wing sail settings luff and leach slots, further improve boundary layer flow by suction through the leeward slot.

(c) the vertical drag vortices downwind of the wing sail is reduced by the flow out the leach.

(d) the slots also improve airflow for the spinnaker set sail.

(e) the softer trailing section of the wing sail, speeds up the windward trailing edge flow of wind, thereby, reducing vertical drag vortices, making the wing sail a "low stall speed" wing.

(f) the boom automatically adjusts the wing sails' draft to changing wind speeds.

(g) the rounded full roach head of the sail reduces induced drag at the head of the sail.

(h) the continuous flexible trailing edge without flaps, which reduce induced drag.

(i) the boomed spare panel stowage, and sail cover configuration, have less induced drag around the foot of the wing sail.

(j) the bottom panels fold one at a time, while the remaining airfoil exposed to the wind retains a desired airfoil shape.

From the description above, a number of advantages of my stowable semi rigid wing sail system become evident.

Operation

The manner of using the stowable wing as a sail for wind powered craft, is similar to the operation of other sail powered systems. All stowable wing sail system settings can be easily, and safely singlehanded from the cockpit. For the stowable wing to be one airfoil for all useable wind conditions there are half as many running rigging lines as other sail powered configurations. The stowable wings' running rigging consists of two halyards 41 for raising sail, which also control headsail twist. There is one line that releases the spring loaded reef hooks 61. There are two downhaul lines 31, one for each sail panel. There are two sheets 59, which are control lines for the dual clews 18. Sheets (FIG. 6E) 59 port and starboard are attached to their respective sail panels clew 18 at their boom cap bail 60, and are then led through deck blocks to the cockpit. (The sheets, deck blocks, and rotating mast brake would come as existing hardware with the sailing craft of this preferred embodiment).

The sheets are used to haul the stowable wing around for selecting the attack angle of the wind. The rotating mast brake sets attack angles of both the wing, and spinnaker sail, with an operating line to the cockpit.

To ready the stowable wing for sailing, (FIG. 9F) the sail cover 65 is untied and dropped down over the spare sail pockets 62. Then retying the lanyards 66 of the sail covers edge in front of the mast, and leaving the lanyards untied behind the mast (FIG. 2), adds a rounded shape to the bottom of the sail.

To raise the stowable wing, one simply hauls the sail up the mast by one or both halyards 41. With the boom in a wing sail configuration, and the attack angle set. Tightening the leeward sheet, with the aid of airflow upon the windward panel (FIG. 3A), a desired camber is bent into the panels due to the flexibility of the booms and sail panels.

By the coil springs 51 (FIG. 6C) pulling the booms together into a wing shape 21, the stowed sail will remain in that position, with up to moderate airflow applied from any direction. To fully stow the wing sail, the sail cover 65 must be lashed across the top of the sail (FIG. 9F). With the wing sail raised, airflow from behind will part the panels, and open the sail to a spinnaker shape (FIG. 3B, 5A, 6E). With airflow removed from behind the spinnaker, the panels will fold back into a wing sail (FIG. 2).

As one sail panel 10 is moved by the airflow in a direction, the other sail panel will follow suit, because of the booms 46 connection to the extending boom 48, and articulating arms 49 and 50. As the stowable wing automatically adjusts draft, the sheeted camber of the airfoil remains the same, with the sheet led close to a ninety degree angle to the boom. The stowable wings' boom adjusts the draft of the wing sail setting automatically to the incidence of the winds speed. Automatic draft adjustment occurs by the booms' spring ability forcing the draft control arms outward (FIG. 6C), and with increased wind and drag on the wing sail, the sail panels and booms move the extending boom backward, forcing the hinged draft control arms to swing the booms' draft inward (FIG. 6D). Thereby decreasing the wing sails draft to a flatter wing sail. As the wind decreases, the coil springs, and spring ability of the boom, pull the draft arms forward returning the wing sail to full draft. The head of the sail panels remain flatter for their higher wind speeds, and the other sections of sail panel follow the shape of the boom.

To change the stowable wing from a wing sail to a spinnaker sail from the cockpit. Haul the windward panel over with its shetet, while turning the craft to catch the wind from behind, and trim the attack angle, and sheets for a well shaped spinnaker sail. The foot of the spinnaker sail setting, is at the full extension of the fore booms' extending boom. Along with the fully extended articulated control arms and the sheeted spinnaker clews. Thus, the foot of the spinnaker is under full control by a five-point hitch. Which is important to avoid broaching the sailing craft.

To change the stowable wing from a spinnaker sail to a wing sail from the cockpit. Head the craft into the wind, and the separated panels will swing back together. Select the attack angle with the rotating mast brake. Trim the desired camber into the wing sail, with the sheet. Tensioning one or the other halyard controls headsail twist.

To reef the stowable wing, whether in the wing sail configuration, or as a spinnaker sail, haul in the downhauls, and slack off the halyards. When the desired reef position has reached the boom, pull the reef hook release line, and pull the last panel down tight. Release the reef line, and tighten the windward halyard for proper headsail twist, and panel rigidity.

The last reef is the stiff cored, heavily reinforced head of the stowable wing sail.

The spare sail pockets are accessed by opening flaps 63 (FIG. 8C) at the clew. The hanked on sails in use, fold down over the stowage pockets when reefing. The sheets running through the pockets bottom clew comers 64, bend the stowage pockets toward the wind. Thus preventing air from flowing down past the foot of the sail.

Air flows into the stowable wing at the luff 27 (FIGS. 3A, 8B) and windward vertical slot 28 (FIGS. 3A, 8B), then exits between the dual panels' leach 29 (FIGS. 3A, 8A). The venturi effect causes air to suck into the wing sail at the leeward vertical slot 30. While I believe the venturi effect occurs because of the action of airflow within the Sto-Wing, I do not wish to be bound by this. The action of air entering at this area 30 of the wing sail, is the point of separated flow, which improves the boundary layer airflow along the leeward surface 75 of the wing sail. Thereby reducing turbulent boundary layer flow toward the trailing edge, which substantially improves lift.

An additional improvement of the stowable wings efficiency comes from the slots airflow, by the way of a medium airflow, exiting the airfoil between the trailing edges of the dual panels. Which reduces direct flow of higher pressure windward air, into the lower pressure of the leeward side. The three zones of airflow combine further from the trailing edge than standard airfoils. Thus, substantially reducing the vertical drag vortices behind the wings trailing edge. This airfoil with slots has a maximum lift coefficient of 4.0; the same wing section without suction slots has a maximum lift coefficient of 1.5. Additionally, the spinnaker set stowable wing has substantially improved airflow, because of the slots (FIG. 3B) 25.

In moderate winds, with the mast brake setting the wing sail fore, and aft in line with the center of the craft, and with the sheets running loose, any point of sail will automatically set an efficient airfoil, with the exception of steering the craft directly into the wind.

For sailing up narrow passages against the wind, the wing sail will perform well enough without bending the boom, by simply heading the craft more toward the wind. With the mast brake loose, and allowing the wind to turn the wing sail toward an attack angle of the wind. Then setting the mast brake, and turning the craft away from the wind slightly. The windward panel will flatten, and the resulting shape of the wing sail will be effective for short tacks.

With a drastic change in the attack angle of the wind, the spinnaker set stowable wing, would reset as a wing sail, or become a reaching sail by loosening the mast brake.

For storm survival, when it is necessary to remove the stowable wing, and stow it on the deck, four pins need to be removed; first two draft control arm pins, and then two tack pins. To remove the stowable wing entirely, it is also necessary to remove the halyards and sheets. For heavy weather knockdown, or loss of a sail panel, the closed cell foam cored sail panels float, when used for a watercraft.

Conclusion, Ramifications, and Scope

Accordingly, the reader will see that the stowable rigid wing sail system of this invention, can be used safely for wind powered craft, with increased speed of the craft, and that it adds convenience to a challenging task. Furthermore, the stowable wing sail panel has the additional advantages in that;

(a) it permits production for several different kinds of wind powered craft;

(b) it provides a lower cost wing sail system for wind powered craft;

(c) it provides the ability for stowing, or reefing of the rigid panels;

(d) it provides a wing sail with automatic airfoil shape adjustment;

(e) it provides a dual panel wing sail that does not substantially increase weight; and (f) it provides one hundred percent efficient use of the winds power.

In addition, the increased efficiency of this wing sail substantially lowers its designed height, and aspect ratio, to equal the same power achieved by standard wings or sails. Therefore, the stowable wing has lower centers of both gravity, and effort. Which translates to less heeling, and further improved efficiency by the wing sail standing up to the wind, for less airflow to spill off.

Although the description above contains many specificities, these should not be construed as limiting the scope of the invention, but as merely providing illustrations of some of the presently preferred embodiments of this invention. For example, there are various possibilities with regard to the relative disposition of sail panel construction, the boom arrangement, and the suspension of the sail;

The foam cores can be constructed with a different material, which would not have the qualities preferred. Also, the sail panels can be laminations of sailcloth, with no foam core.

The wing sail can be efficient without the high lift devices made into its panels.

The wing sail can fold all at once as accordion folds, by not having the downhauls with jams. Also, the sail panels can fold down without the core cutouts.

The fore boom can be attached to a nonrotating mast with a fixed gooseneck fitting, or a stay wire can replace the mast as the backbone of the wing, both would have extra sheets taking the place of the mast brake.

The mast or a stay can form the leading edge within the wing, and loose the automatic draft reduction, to be manual draft reduction.

The boom can be a single part that functions as a wraparound leaf spring etc.

The wing sail can be hoisted by using only one halyard.

Thus the scope of the invention should be determined by the appended claims and their legal equivalents, rather than by the examples given.

I claim:

1. A semi rigid airfoil assembly, functioning automatically with respect to an airflow, as a draft adjusting wing sail or as a spinnaker sail, for use with a freestanding mast having a halyard on a wind powered craft, the improvement wherein, said semi rigid airfoil is a stowable rigid wing, and has a plurality of higher lift to drag ratio characteristics, of the type comprising:

(a) a port and a starboard semi rigid sail which are vertically disposed consisting of a plurality of rigid foam core panels that are sandwiched horizontally with an adhesive between an inboard and an outboard flexible sailcloth material, thereby having a separating space between each rigid panel, whereby the separating spaces are a flexible sailcloth material lamination and are a means wherein the rigid panels bend in an alternating accordion form of a plurality of inward and outward folds, thereby folding the semi rigid sails downward and over an outside of and connected to a "wing chord section shaped" boom that is in a parallel disposition to the rigid panels and separating spaces;

(b) the port and starboard sails to each have a plurality of midchord spanwise and leading edge airflow slots for higher lift, and the slots airflow to exit between a trailing spanwise port and starboard sails edges, along with the trailing edges to also each have a plurality of concave depressions for low stall, the high lift slots altogether combined with the low stall concavities for a decreased vertical drag vortice abaft the wing sail;

(c) means provided for mounting the airfoil assembly from a head of the sail to a foot of the sail so as to partially or entirely surround the mast;

(d) means provided for a shape control of the sails to be a wing chord section profile;

(e) means provided for a plurality of downhauls with a reefing operation of the sail panels;

(f) a "full draft wing chord section profile" flexible boom slidably attached to the mast by means of a telescoping foreboom pivotably connected to the mast, and for a port and a starboard draft control arm to adjustably pivot a full draft of the flexible boom inboard to a "minimum draft wing chord section profile", the leading edge of the boom to be a pivotable connection of a port and a starboard side of the boom, the booms' pivotable connection being attached to a forward end of the telescoping foreboom, thereby an alternate movement of a port and starboard sides of the boom away from the mast;

(g) means provided for a plurality of spare folded sail panels to be stowed.

2. The semi rigid airfoil assembly of claim 1, which comprises a port sail adjacent to and communicating with a starboard sail in a altogether vertically elongated disposition, whereby:

(a) the port sail has a leading and a trailing edge, and the starboard sail has a leading and a trailing edge;

(b) the port and starboard sails' each have a midchord forward opening slot, wherein;

i. the port sail consists of an afterward spanwise sail sections' leading edge overlapping the outboard of a forward spanwise sail sections' trailing edge, the fore and aft spanwise sail sections are connected together at vertical intervals where they are overlapped at the midchord;

ii. the starboard sail consists of an afterward spanwise sail sections' leading edge overlapping the outboard of a forward spanwise sail sections' trailing edge, the fore and aft spanwise sail sections are connected together where they are overlapped at the midchord horizontally inline with the port sail vertical interval connections;

(c) the port and starboard sails' leading edges' are connected together horizontally inline with the same vertical intervals where the spanwise midchord overlapped sail sections are connected together;

(d) the sails surround across and around a forward side of the mast, the mast is positioned within and about the midchord of the wing sail configured airfoil with the sails port and starboard trailing edges adjacent to each other;

(e) the semi rigid airfoil in a wing sail configuration with a frontal airflow applied to the leading edge, a plurality of forward opening slots and a plurality of windward opening slots are formed in an area between where the sail sections are connected, the leading edge slots and windward slots airflow thereby exiting between the sails trailing edges improves the lift characteristics on a leeward side of the wing sail by way of a venturic suction in a plurality of leeward slots improving a boundary layer airflow across a leeward spanwise afterward sail section.

3. The semi rigid airfoil assembly of claim 1, which comprises the port and starboard sails consisting of a laminated material, the sails containing a plurality of thin "non-crosslinked polyvinyl chloride foam" core panel sections, the foam cored panels are sandwiched with an adhesive between sailmakers sheet materials on each side thereof, and foam cored from the sails leading to trailing edges, the foam panels are perpendicular to the elongation and have a separating space that is parallel between each of the foam panels, a sail span to foam core thickness ratio is to be 2,000 to 1 or less, the separating spaces are located horizontally across the port and starboard sails midway between and also where the sails leading edges and spanwise overlapped sections are connected at vertical intervals, the separating spaces in line with the sails' connected intervals are to increase in a separation of a "full draft chordal shaped upward cambered curve" from about the leading edge to the trailing edge of the sails, the increased separating space sailcloth areas are more flexible than the foam cored areas for a means of folding the semi rigid sail panels inboard, inboard folding separating spaces are provided at the bottom of the port and starboard sails and are connected to a "full draft chordal shaped flexible boom", the separating spaces between the connected intervals are a means of folding the semi rigid sail panels outboard, a trailing spanwise quarter of the port and starboard sails have a plurality of foam cores cutout in a half elliptical shape centered on the outboard folding separating spaces to be more flexible than the foam cored panel areas for folding the semi rigid sail panels, with an airflow applied to a windward side of the wing sail a plurality of elliptical flexible spaces form a plurality of concave depressions for a low stall wing speed aerodynamic characteristic.

4. The semi rigid airfoil assembly of claim 1, which comprises the semi rigid foam cored sail panels whereby the flexible inboard and outboard folding separating spaces of laminated sailcloth without rigid foam cores allow a folding of the vertically elongated sail panels in a downward direction to a substantially smaller vertically elongated airfoil of sail panels.

5. The semi rigid airfoil assembly of claim 1, which comprises the port and starboard sails having a "wing chord sectional profile" by means of a plurality of shape control lines that are in an adjustably tensioned alignment along the inboard sides of the port and starboard inboard folding separating spaces, an end of the shape control lines is led outboard through a grommet at the leading edge of the port sail and is led inboard through a grommet at the leading edge of the starboard sail, the shape control lines thereby forming the vertically connected intervals along the leading edge of the sails, the ends of the shape control lines are then led along their respective sails inboard folding separating spaces and through a midchord downhaul jam and then each end is adjustably connected to its' respective sails trailing edge.

6. The semi rigid airfoil assembly of claim 1, which comprises a plurality of downhaul jams consisting of a grommet fastened out of alignment with and across from another grommet in a loop of sailcloth material, the downhaul jams are attached at about a midchord position, of the inboard side of each of the inboard folding separating spaces, the sail panels have a plurality of reef positions along inboard folding spaces and have a reef ring attached to an end of each midchord downhaul jam and at each of the leading and trailing edges of the inboard side of the port and starboard sails, the shape control lines are led through the leading edge reef rings and are then led through the midchord reef rings and are adjustably connected to the trailing edge reef rings, the shape control lines along the reef positions hold the reef rings out perpendicular to the sail for reception of a plurality of reef hooks that are pivotably connected to an inboard side of the boom and vertically in line with their respective reef rings' positions, the shape control lines tension the midchord reef rings connected with their downhaul jams, and the other shape control lines tension their downhaul jams, whereby a plurality of downhaul lines are jammed by the downhaul jams tensioning their misaligned grommets, the downhaul line is attached to an inboard side of each of the heads of the port and starboard sails and is led through the downhaul jams' grommets consecutively from the head to the foot of the sails, the effect of a hauling down on the downhaul lines when reefing the sail panels causes the downhaul jams to come into a contact with the boom, a bottom side of the downhaul jams sailcloth loop coming into contact with the boom is bent and the grommets become aligned for the downhaul line to be a free sliding operation, whereby the sail panels fold outboard and down along an outboard side of the boom one outboard folding separating space at a time and the remaining sail panels in an aloft disposition are a stable low drag airfoil.

7. The semi rigid airfoil assembly of claim 1, comprising a pivotably connected leading edge of a "full draft chordal shaped flexible boom" for a port and starboard side of the boom to pivot outward from each other, the pivoting leading edge of the boom is connected to a forward end of an extending boom, the extending boom has a slidable connection to and inline with a foreboom so that the boom with attached sail panels altogether rotate at a halyard connection upwards on the mast and move fore and aft in relation to the mast, the foreboom is distally and pivotably connected to the forward side of the mast, a port and starboard spinnaker control arm is springably and pivotably connected to each side of a forward end of the foreboom, a port and starboard draft control arm is pivotably connected between each of an outboard end of the spinnaker arms and the inboard sides of the boom at about a midchord location, a boom cap bail is provided at each of a port and starboard booms' trailing ends for an attachment of control sheets.

8. The semi rigid airfoil assembly of claim 1, comprising the port and starboard sail panels attached to the boom forming an airfoil shaped wing sail whereby:

(a) the port and starboard spinnaker arms are springably positioned in an aft direction parallel to the foreboom, the aft sprung position of the spinnaker arms set a neutral state position for a boom assembly altogether;

(b) the neutral state of the port and starboard draft control arms are in a perpendicular direction to the spinnaker arms with the port and starboard sides of the boom pivoted afterward to a full draft airfoil setting, including the extension boom being in a partially retracted position;

(c) an effect of a stronger airflow upon a wing sails forward side effects the sail panels to move the boom afterward out of the neutral state, whereby the extending boom slides in an aft direction and the draft control arms pivot in an aft direction and in toward the mast thereby decreasing a draft of the flexible wing section shaped boom, wherein the sails attached to the boom also decrease in a wing draft;

(d) an alternative effect of a airflow upon an afterward side of the wing sail with the boom in the neutral state will effect a spreading apart of the trailing edges of the wing sail, whereby the sails connected to the pivotable boom, thereby effecting the interconnected spinnaker and draft control arms to altogether pivot in an outward and a forward direction from their respective sides of the mast, which effect also slides the extension boom to a full extension, therein reconfiguring the wing sail to a spinnaker sail forward of the mast;

(e) the spinnaker set airfoil has a opening spanwise slot configuration for an airflow to effect a directed turbulence on the leeward side of the spinnaker sail.

9. The semi rigid airfoil assembly of claim 1, which comprises a pocket of sailcloth attached along and around the length of the bottom of the "wing chord section shaped boom" with a opening and a closure means at the port and starboard boom ends for the insertion of a spare folded rigid panel on the port and starboard sides.

10. A semi rigid airfoil assembly functioning automatically to an airflow as a draft adjusting wing sail or as a spinnaker sail for use on a sailing craft with a mast of the type further comprising:

(a) a plurality of semi rigid sail panels consisting of a plurality of rigid panels with a plurality of flexible sections for folding a vertically flat rigid panel over a horizontal outward cambered chordal curve;

(b) means provided for hoisting the sail panels having a head and mounting a sail panels foot upon the boom and surrounding a forward side of a mast on a wind powered craft;

(c) a "full draft wing chord section shaped" flexible boom is slidably attached to the mast for a plurality of draft control arms to pivot and adjust a booms draft, a leading edge of the boom pivots and a port and a starboard side of the boom separate outward from the mast;

(d) means provided for a downhaul and a reefing of the sail panels;

(e) means provided for a wing chord section shape from the foot to the head of the sail panels.

11. The semi rigid airfoil assembly of claim 10, comprising a plurality of flat panel sections consisting of a multiplicity of laminated materials adjacent to and communicating with each other are in a vertically elongated disposition on the port and starboard sides of a mast, whereby the flat panels are a port and a starboard sail panels' having a leading and a trailing edges, the flat panels of material are composed of a plurality of "thin rigid closed cell foam panel sections" that are sandwiched horizontally with adhesive between sailcloth materials, the foam panels sandwiched within the flat rigid panels are lofted with a narrow separating space between the foam panels perpendicular to the elongation, the multiple parallel foam panels with separating spaces extend from the leading to the trailing edge of the semi rigid panels, the separating spaces in the port panel are aligned with the separating spaces in the starboard panel, the port panel leading edge is joined to the starboard panel leading edge at every other one of the separating spaces, the separating spaces across the port and starboard panels where designated for joining together increase in separation from about the leading edge to the trailing edge of the semi rigid panels, the port and starboard panels fold in toward the mast where the increased separating spaces leading edges are joined, the port and starboard panels fold outward from the mast where the narrow separating spaces leading edges are not joined, the semi rigid sail panels whereby the flexible separating spaces of a laminated sailcloth section without a foam core enable the foam cored rigid panels to fold altogether downward to a substantially smaller stack of folded panel sections.

12. The semi rigid airfoil assembly of claim 10, comprising a headboard panel to be connected to the top of the port and starboard sail panels with means for receiving attachment of a halyard for raising the sail panels altogether up the mast, a foot board is to be connected to the bottom of an inboard folding separating space of the port and starboard sail panels, the port and starboard foot boards are connected to their respective sides of a "full draft wing chord shaped flexible boom".

13. The semi rigid airfoil assembly of claim 10, comprising a leading edge of a "full draft wing chord shaped flexible boom" to be a pivotable connection of a port and starboard side of the boom to pivot outward from each other, the pivoting leading edge of the boom is connected to an extending foreboom, the extending foreboom is slidably connected to a foreboom so that the boom with attached sail panels altogether move fore and aft in relation to the mast, the foreboom is pivotably connected to the forward side of the mast, a port and a starboard spinnaker control arm is pivotably connected to a forward end of the foreboom, a port and a starboard draft control arm is pivotably connected between the outboard ends of the spinnaker arms and the inboard sides of the boom at the midchord, a springable line is connected between the forward end of the foreboom and the draft control arm pivotable connections at the inboard side of the port and starboard sides of the boom.

14. The semi rigid airfoil assembly of claim 10, comprising the port and starboard sail panels connected to a boom assembly altogether forming an automatic draft adjusting wing sail, or an automatic setting spinnaker sail, whereby;

(a) the port sail panel and a port side of the boom are situated on a port side of the mast, and the starboard sail panel and starboard side of a boom are situated on a starboard side of the mast with the sail panels altogether raised up the mast by means of the halyard, and, (b) the port and starboard spinnaker arms are springably positioned in an aft direction adjacent to and parallel to the foreboom, the port and starboard draft control arms are springably perpendicular to the spinnaker arms with the port and starboard sides of the boom pivoted afterward to a full draft airfoil setting, and, (c) an effect of a stronger airflow on the wing sails leading edge causes the sail panels and boom to move afterward, whereby the extending boom slides aft and the draft control arms pivot aft in toward the mast thereby decreasing airfoil draft, and, (d) alternatively, the forward movement of the extension boom effects the pivotable leading edge of the boom with connected panels and spinnaker arms with interconnected draft control arms to pivot outward from the mast thereby reconfiguring the wing sail to a spinnaker sail forward of the mast.

15. The semi rigid airfoil assembly of claim 10, comprising a plurality of downhaul jams to be constructed consisting of a set of two grommets fastened in a loop of sailcloth material, whereby the grommets are out of alignment across from each other, the downhaul jams are connected to the inboard side of each sail panel at the midchord of each separating space that folds inboard, a plurality of downhaul lines are connected to each of the inboard sides of the port and starboard headboards of the sail panels in alignment with the midchord, the downhaul lines are led through the grommets of the downhaul jams from the head to the foot of the sail panels and through an aligning hole in the boom, a plurality of reef hooks are pivotably connected on the inboard side of the port and starboard booms, the reef hooks are located at the midchord and the leading and trailing edges, a springable line is attached inline to the reef hooks altogether for engaging effect, a control line is attached inline to the reef hooks altogether for disengaging the reef hooks, a plurality of sailcloth reinforced reef slots are provided along the infolding separating spaces in the port and starboard sail panels where designated as reef positions, the reef slots are positioned along the separating spaces perpendicularly in line with their corresponding reef hooks from the boom.

16. The semi rigid airfoil assembly of claim 10, further comprising the sail panels having an "airfoil chord sectional profile" by means of a plurality of shape control lines along the inboard side of each separating space that folds the sail panels inboard, the shape control lines are tensioned at a predetermined rate to shape a chordal profile of the sail panel at that location, the sail panels shape control lines are attached to the trailing edges and led through the midchord downhaul jam loops and are connected to the leading edges, the tension of the shape control line upon the midchord downhaul jam tensions the misaligned grommets for jamming the downhaul line.

17. The semi rigid airfoil assembly of claim 10, further comprising a plurality of semi rigid panel sections of a laminated sailcloth material adjacent to and communicating with each other in a vertically elongated disposition, a port and a starboard semi rigid panels of material are each composed of a forward spanwise sections trailing edge overlapped by a afterward spanwise sections leading edge, the spanwise overlapped sections form an airfoil of sail panels having a leading and a trailing edge, whereby the semi rigid panels surround the mast as a port and starboard sail panel, the semi rigid panels consist of a plurality of chordwise "rigid sailcloth core panel sections" that are sandwiched with an adhesive between a plurality of flexible sailcloth sections, the rigid sailcloth cores sandwiched within the semi rigid panels are lofted with a separating space between the rigid cores in a perpendicular direction to the elongation, the multiple parallel separating spaces extend from the leading edge to the trailing edge of the sail panels, the separating spaces in the port panel are aligned with the separating spaces in the starboard panel.

18. The semi rigid airfoil assembly of claim 10, further comprising a plurality of semi rigid panel sections of a laminated sailcloth material adjacent to and communicating with each other are in a vertically elongated disposition, whereby a semi rigid panel surrounds the mast as a port and a starboard sail panel having a leading and a trailing edge, the semi rigid panels of material are composed of a plurality of "rigid sailcloth core panel sections" that are sandwiched with adhesive between a plurality of flexible sailcloth sections, the rigid sailcloth cores sandwiched within the semi rigid panels are lofted with a separating space between the rigid cores in a perpendicular direction to the elongation, the multiple parallel separating spaces extend from the leading edge to the trailing edge of the sail panels, the separating spaces in the port panel are aligned with the separating spaces in the starboard panel.

* * * * *